US005315982A

United States Patent [19]

Ward et al.

[11] Patent Number: 5,315,982

[45] Date of Patent: May 31, 1994

[54] HIGH EFFICIENCY, HIGH OUTPUT, COMPACT CD IGNITION COIL

[75] Inventors: Michael A. V. Ward, Lexington, Mass.; Richard Redl, Onnens, Switzerland

[73] Assignee: Combustion Electromagnetics, Inc., Arlington, Mass.

[21] Appl. No.: 640,390

[22] PCT Filed: May 12, 1990

[86] PCT No.: PCT/US90/02665

§ 371 Date: Apr. 15, 1992

§ 102(e) Date: Apr. 15, 1992

[51] Int. Cl.[5] ..... F02P 11/00

[52] U.S. Cl. ..... 123/634; 123/598; 123/605; 123/620

[58] Field of Search ..... 123/634, 606, 598, 620, 123/596, 604, 605, 607, 637, 143 B, 594, 631, 636

[56] References Cited

U.S. PATENT DOCUMENTS

| | | | |
|---|---|---|---|
| 2,840,623 | 6/1958 | Middleton | 123/634 |
| 3,934,570 | 1/1976 | Asik et al. | 123/634 |
| 4,395,999 | 8/1983 | McKechnie | 123/634 |
| 4,446,842 | 5/1984 | Iwasaki | 123/606 |
| 4,459,967 | 7/1984 | Nayashi | 123/634 |
| 4,509,495 | 4/1985 | Betz et al. | 123/634 |
| 4,662,343 | 5/1987 | Smith | 123/605 |
| 4,677,960 | 7/1987 | Ward | 123/598 |
| 4,774,914 | 10/1988 | Ward | 123/634 |

*Primary Examiner*—Raymond A. Nelli
*Attorney, Agent, or Firm*—Jerry Cohen

[57] ABSTRACT

A high efficiency, high output, compact ignition coil particularly suited for use in capacitive discharge, multiple pulsing ignition systems, with about ten turns of primary (1) wire (Np) and about five hundred fifty turns of secondary (2) wire (Ns) for an input voltage Vp of approximately 350 volts and a peak output voltage Vs of 30 kV, the core and windings of the coil featuring separate and different primary (31) and secondary (41) core halves structured on the basis of herein developed coil open and closed circuit criteria such that the core half (31) containing the primary winding has a large center post (32) of cross-sectional area Ap with a narrow slot of width W1 around the post (32) for winding the primary wire (1) to provide essentially the total required coil leakage inductance Lpe of about 50 uH for an input capacitance of about 5 uF and spark discharge frequency fcc of about 10 kHz, and the secondary core (41) structured to have a center post (42) of cross-sectional area As about half that of Ap to provide a much larger winding width W2 than W1 to efficiently support the many layered larger coil secondary winding (2) for a same overall outer core diameter D of the coil comprising a pot core or "E" type core structure.

48 Claims, 10 Drawing Sheets

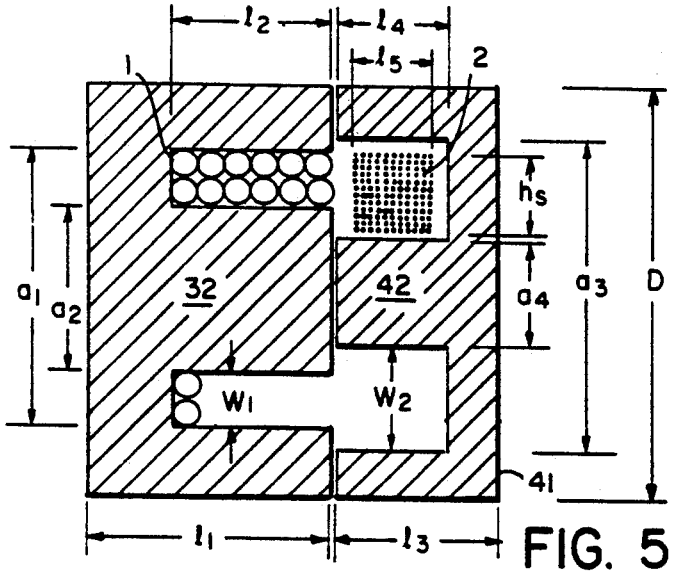
FIG. 5
| | |
|---|---|
| $l_1$ = 1.5" | $a_1$ = 1.6" |
| $l_2$ = 1.0" | $a_2$ = 1.0" |
| $l_3$ = 1.0" | $a_3$ = 1.9" |
| $l_4$ = .70" | $a_4$ = .6" |
| $W_1$ = .30" | $W_2$ = 5/8' |
| D = 2.50" | $B_{sat}$ = 1+T |
FIG. 5a
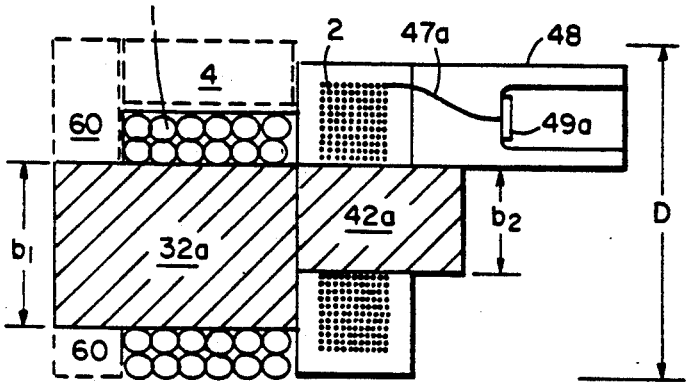
FIG. 6
| | |
|---|---|
| $b_1$ = 1.0" | |
| $b_2$ = 0.6" | |
| $D_1$ ≃ 2" | |
FIG. 6a
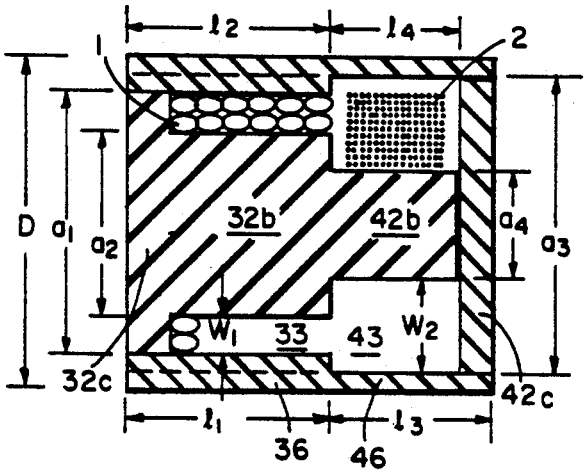
FIG. 7
| | |
|---|---|
| $l_1$ = 1.25" | $a_1$ = 1.65" |
| $l_2$ = 1.0" | $a_2$ = 1.15" |
| $l_3$ = 1.0" | $a_3$ = 1.75" |
| $l_4$ = 0.8" | $a_4$ = .65" |
| $W_1$ = 0.25" | $W_2$ = .55" |
| D = 2.0" | $B_{sat}$ = .45T |
FIG. 7a

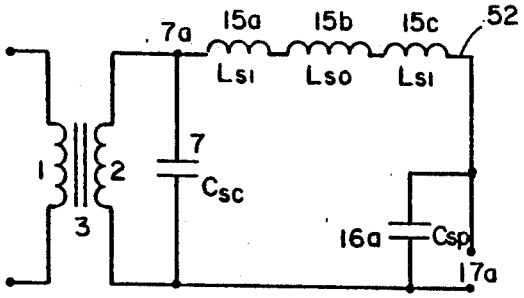
FIG. 11
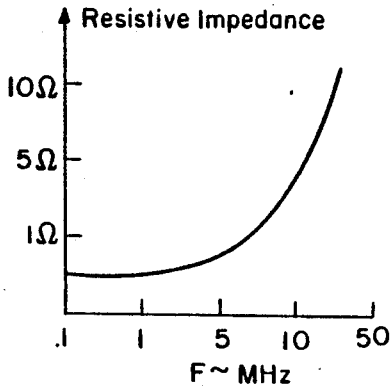
FIG. 12
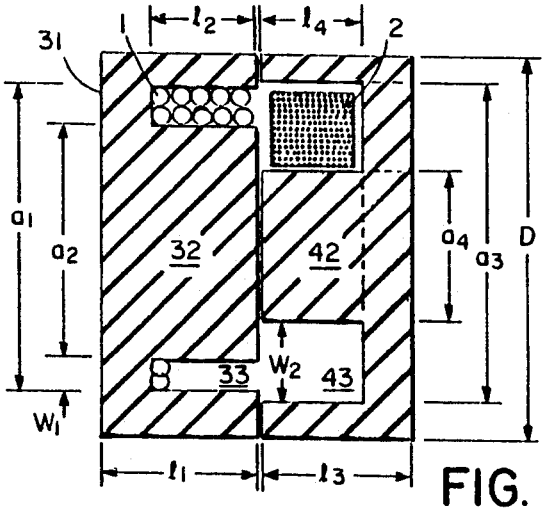
FIG. 13
| | |
|---|---|
| $l_1$ = 1.25" | $a_1$ = 2.25" |
| $l_2$ = 0.90" | $a_2$ = 1.65" |
| $l_3$ = 1.0" | $a_3$ = 2.40" |
| $l_4$ = 0.72" | $a_4$ = 1.20" |
| $W_1$ = 0.28" | $W_2$ = 0.60" |
| D = 2.75" | Bm = 0.45T |
FIG. 13a
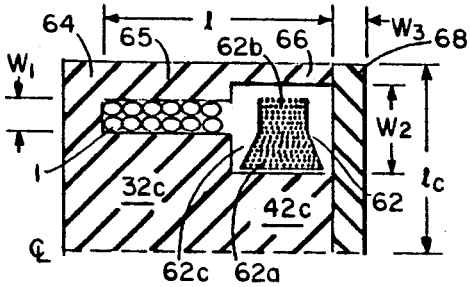
FIG. 14
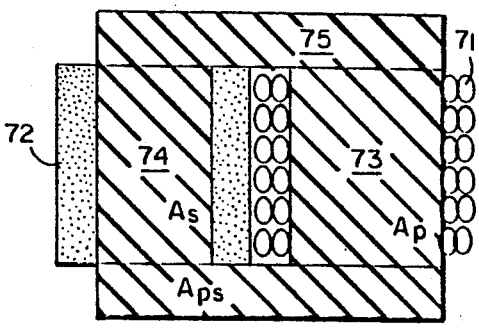
FIG. 15

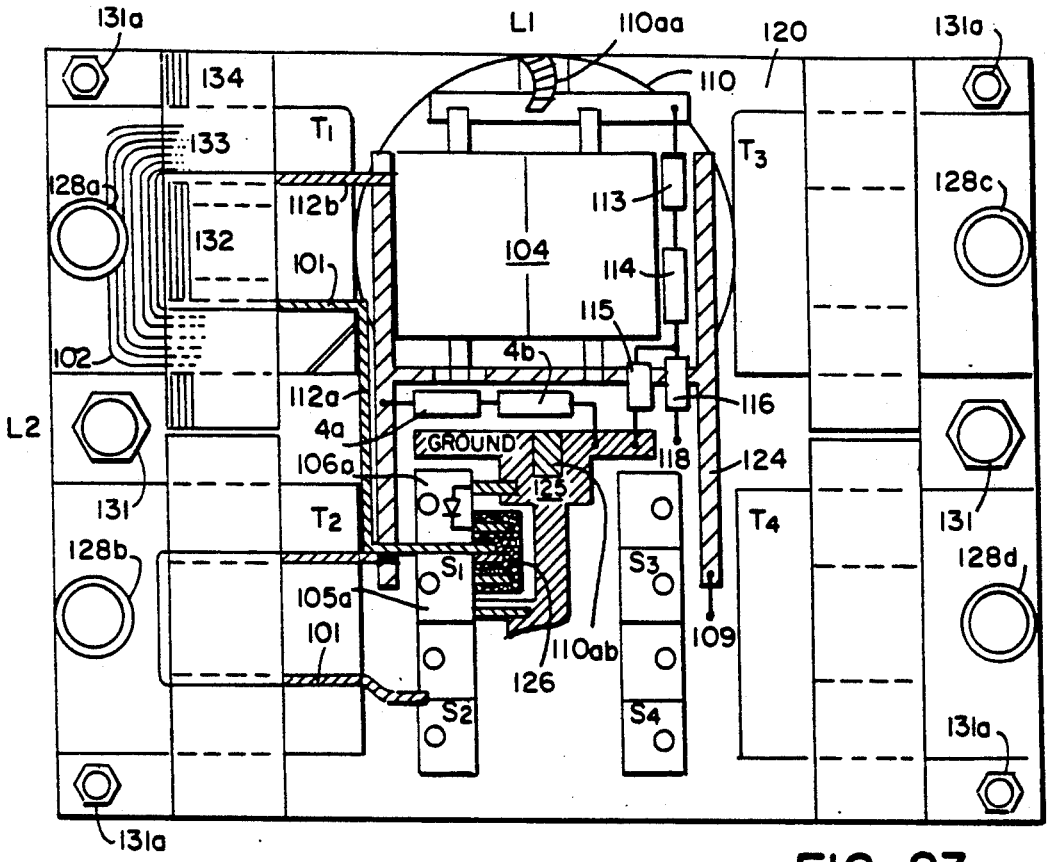
FIG. 23
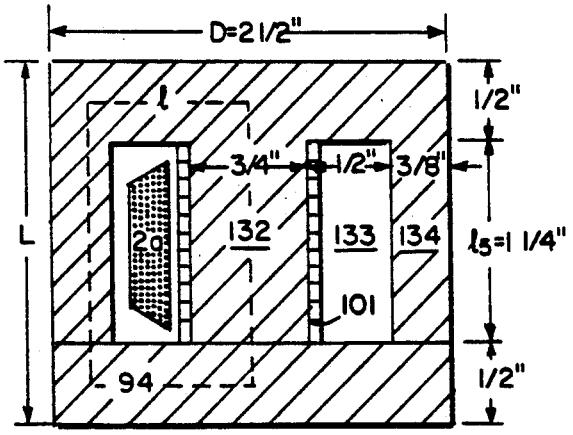
FIG. 23a
FIG. 23b
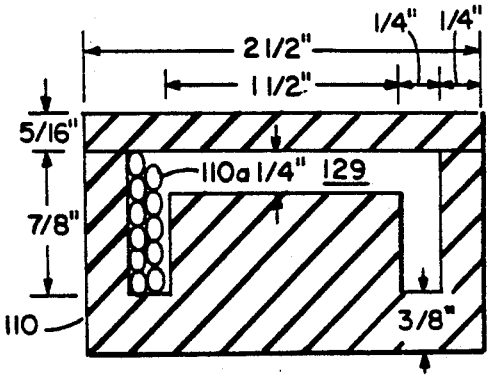

HIGH EFFICIENCY, HIGH OUTPUT, COMPACT CD IGNITION COIL

BACKGROUND OF THE INVENTION AND PRIOR ART

The present invention relates to ignition coils for ignition systems for igniting air-fuel mixtures, and particularly for use in systems using capacitors for storing higher levels of ignition energy, i.e. high energy capacitive discharge ignition systems, and for delivering the energy in the form of a rapidly pulsing (multi-strike) sequence of spark pulses.

Considerable research has been conducted on ignition systems for internal combustion engines for improving their capability to ignite air-fuel mixtures. More specifically, during the past few decades, there has been work done on improving the ability of ignition systems to ignite air-fuel mixtures with poor ignition characteristics, especially of the inherently cleaner and more efficiently burning leans air-fuel mixtures.

Much of the prior art work on so called high energy ignition has focussed on alternative approaches other than coil design for delivering high ignition energy. Little attention has been given to improving the actual coil design, particularly in view of the recent development of the high efficiency, voltage doubling, low turns ratio coil principle disclosed in U.S. Pat. No. 4,677,960 referred to hereinafter as the Voltage Doubling Coil principle, or Doubling principle for short.

Prior art work on spark ignition, including ignition coils, are numerous, and for example, are summarized in Edward F. Obert's book, "Internal Combustion Engines and Air Pollution", pp. 532 to 566, *Spark-Ignition Engines*, Intext Educational Publishers, 1973. The work reported by Obert, and the work published since then, including the coil design presented in the above patent, are based on well established principles of designing coils by either winding the primary and secondary windings essentially concentrically, or on different arms of a closed magnetic core for high leakage inductance. Included are various ways of performing the winding, especially the much longer secondary winding, and these are well known to one skilled in the art.

SUMMARY OF THE INVENTION

On the other hand, the present invention is based in part in a) recognizing that the open circuit (high voltage) and the closed circuit (high current) properties of ignition coils can be separated, especially for approaches based on the Doubling principle, and that each part of the coil is different and can be designed to be optimized separately from the perspective of minimizing resistive and core losses and core size and overall coil size, and b) acting effectively on the basis of such recognition.

Specifically, the effective constructions of two different core cross-sectional areas and core shapes are arrived at for the primary and secondary windings, the secondary requiring about half or less the core area of the primary depending in part on the output capacitance and core material to accomodate a larger winding area. Moreover, given that a high leakage inductance Lpe is preferred, i.e. of about 50 microhenries for an input capacitance Cp of about 5 microfarads, a preferred embodiment is developed in which the windings are placed axially side-by-side for easy containment in each half of pot or E type core, having low EMI, i.e.

electromagnetic interference. As a further result, for a primary voltage Vp of 350 volts, a preferred design is possible with only about ten turns of primary winding (and 500 turns of secondary winding as per the Voltage Doubling principle).

As part of an overall optimized ignition system as disclosed in U.S. patent application Ser. No. 131,948, the present coil structure family (i.e. family of designs of such structures within the present invention) lends itself to a more optimally defined spark pulsing wave shape of the capacitive discharge circuit disclosed in that patent application, including the recharge circuit disclosed therein. Moreover, such new coil structures make possible further system optimization and extensions, as in distributorless ignition systems now made possible by the compact nature of the coil structures. For example, for such distributorless ignition system applications, there is disclosed an improved spark plug wire based on principles disclosed in U.S. Pat. No. 4,744,914, which tunes the capacitance spark generated by the coil invention to allow the spark to pass with minimum attenuation while strongly damping the high frequency spark components (greater than 30 MHz) which cause EMI. And furthermore, when used with the preferred spark plug of the Electric Field Focussing Lens (EFFL) type disclosed in application Ser. No. 131,948, the coil is preferably designed to give a positive versus conventional negative initial high voltage output polarity.

In another aspect of the side-by-side winding feature of the coil invention two different magnetic materials can be used for each core half, a low loss (preferably ferrite) material for the half in which the primary wire is wound and a low cost (higher loss) high magnetic saturation material (preferably Silicon Iron) for the half on which the secondary winding is wound. Furthermore, the high leakage inductance (Lpe) primary winding of the coil can be divided into two parts, a first part (Lpe1) that is coupled to the secondary winding through either concentric or side-by-side, i.e. colinear windings constituting a transformer (the coil), and a second part (Lpe2) that is contained in a separate stand alone core comprising a separate leakage inductance choke. This design provides several important advantages.

One advantage is that by decoupling part of the primary leakage winding from the secondary winding it reduces the AC losses of the secondary winding due to a lower primary winding leakage flux cutting the secondary winding turns. It also reduces the overall transformer core losses by weighing the total core losses in proportion to the leakage inductance of each part so that the lower loss separate leakage choke (the second part) can have a much higher weighting factor (by designing Lpe2 to be much greater than Lpe1). In this way lower cost, higher magnetic saturation, higher loss material, e.g. Silicon Iron (SiFe), can be used for the first transformer part to reduce overall cost.

A second advantage is that the separate leakage choke permits especially simple and low cost forms of distributorless ignition by allowing the single leakage choke Lpe2 to be shared between several transformer coils (of very low leakages Lpe1i) which can be made very small and cheap through the use of SiFe laminated magnetic core material.

CERTAIN FEATURES AND OBJECTS OF THE INVENTION

The following stated features of the invention are part of the description of the invention itself.

It is a principal feature of the present invention to provide a new and improved ignition coil which is compact and efficient (low number of winding turns and hence low winding resistance) and is suitable for use in very high power (hundreds of watts), high efficiency, multi-pulsing capacitive discharge (MPCD) circuits based on the Doubling principle, for igniting very lean and otherwise difficult to ignite air-fuel mixtures. In particular, it is a feature to provide new coil design criteria for separately located primary and secondary coil windings based on the closed circuit and open circuit operation of the coil which define the design of the coil structure and windings, such that the core sizes of the two separate windings based on the new design criteria lead to secondary winding core cross-sectional area about one half of that of the primary core cross-sectional area.

Another feature of the present invention is to design the core halves such that under normal operating conditions the respective core halves, for low loss core ferrite material, are stressed to near their magnetic flux-density saturation levels.

Another feature of the present invention is to advantageously use the new coil design criteria to develop coils suitable for MPCD applications with only about ten turns of primary wire for about 350 volts of coil primary side voltage Vp with each winding preferably contained in each half of a pot or E type core.

Another feature of the present invention is to design the coil to be used effectively with an MPCD ignition circuit including preferably a recharge circuit (an MPCDRC ignition) to provide closely spaced, e.g. 250 to 500 microsecond (usec) spark pulses of approximately constant or slowly decaying amplitude, and preferably designed such that if the first spark pulse misfires the coil will permit the recharge circuit to raise the primary, and hence secondary voltage of the second pulse to a higher value.

Another feature of the present invention to design the capacitance (Csc) of the secondary winding of the coil invention so that it is of low value, e.g. 20 to 40 picofarads (pF), by making use of the coil invention design principles and by utilizing low dielectric constant material in the secondary winding.

Another feature of the present invention is to minimize both the secondary (output) coil capacitance Csc and the secondary AC (alternating current) resistance by utilizing the new coil design criteria to wind the secondary with an essentially square winding or a winding with more layers Nl than turns Nt per layer.

Another feature of the present invention is to provide a variable turns Nti per ith layer where over some range of values of layers Nti decreases to increase the clearance of the higher voltage turns from the (ground) ferrite core sidewalls.

Another feature of the present invention is to make use of the coil secondary winding capacitance Csc for effective sparking (capacitive spark) by designing the high voltage lead connecting the coil output terminal to the spark plug to lower the frequency of transmission of the capacitive spark to 5 to 15 Megahertz (MHz) so that it is delivered with small attenuation to the spark gap while energy flowing above 30 MHz is strongly attenuated.

Another feature of the present invention is to contain the above mentioned high voltage lead in a grounded shield terminating at the coil core outer surface and at the plug shell for low EMI.

Another feature of the present invention is to make use of the preferred axially side-by-side coil winding and to use two layers of primary winding such that the beginning and end of the primary winding are in close proximity of each other.

Another feature of the present invention is to use the coil as part of a CD circuit with the discharge circuit mounted on or in close proximity of an outer surface of the core on which the primary winding is wound with preferably a two layer primary winding such that the two ends of the winding locate very closely to the discharge circuit and require a length of preferably no more than one to two inches of primary winding wire to make the connection to the discharge circuit.

Another feature of the present invention is to incorporate the preferred axially side-by-side windings essentially in each half of a core with one or more similar outer diameters but otherwise differing dimensions as dictated by the new coil design criteria.

Another feature of the present invention is to use a pot type core such that two layers of wire are used in the primary winding which start and terminate at one end surface of the pot core half and the secondary high voltage end of the winding is terminated at the opposite end surface of the pot core.

Another feature of the present invention is to use wire for the coil which is chosen and oriented such that the AC resistance of the wire at its principal operating frequency is preferably less than a factor of two of its DC (direct current) resistance, such as Litz wire of suitable strand size.

Another feature of the present invention is to use a Litz wire for the primary winding and a suitable wire in the secondary winding with a diameter preferably equal to about one half the skin depth as defined by the operating frequency of the CD spark discharge oscillation frequency, which is preferably about 10 kHz (kilohertz) for a skin depth of about 0.030 inches for copper. and a diameter of about 0.015" for the secondary winding wire.

Another feature of the present invention is to use a solid conductor wire in the secondary winding whose copper diameter is between one third and two thirds the skin depth, i.e. between 0.010 and 0.020 inches for 10 kHz operating frequency.

Another feature of the present invention is to wind the secondary wire in an essentially rectangular winding cross-section whose larger winding dimension is essentially parallel to the leakage magnetic field produced by the primary winding.

Another feature of the present invention to design the coil on the basis of the Doubling principle, i.e. the high efficiency low turns ratio voltage doubling principle, to be used in a MPCD circuit with primary circuit capacitor Cp of about 5 microfarads charged to preferably about 350 volts, preferably used in conjunction with a recharge circuit with capacitance Ce one quarter to one half the value of Cp and recharge circuit inductance Le of about 20 millihenries (mH) and total secondary circuit capacitance Cs preferably no more than 100 pF contained principally in the spark plug (and coil for distributorless ignition) with the spark plug preferably having a toroidal gap of the electric field focussing lens (EFFL) type.

Another feature of the present invention is to design the coil invention such that it provides a positive polarity high voltage output versus the conventional negative polarity in order to minimize plug fouling.

Another feature of the present invention is to use the coil with a toroidal gap focussing lens type plug (EFFL plug) with a firing end button tip made of small diameter, e.g. 0.25" to 0.30", erosion resistant material such as Tungsten-Nickel-Iron, Tungsten-Nickel-Copper, or others, and the plug ground ring made up of similar material, to be able to withstand the higher spark pulsing power made possible by the present high efficiency coil design.

Another feature of the present invention is to use the coil with an EFFL plug with preferably a plug capacitance Csp of about 40 pf and a minimum output coil capacitance Csc.

Another feature of the present invention is to design the firing end of the EFFL plug such that it provides an approximately 0.1" spark gap which is at an approximately 45 degree angle to the vertical axis defined by the plug length to minimize the chances of plug fouling.

Another feature of the present invention is to use the coil invention in conjunction with an MPCDRC ignition system using low forward drop SCRs as the spark pulsing switches of one volt forward drop or less at 100 amp current, and capable of producing closely spaced multiple spark pulses of short oscillation period of 80 to 120 microseconds, brought about by a speed-up shut-off circuit which applies a negative bias to the SCR trigger gate during SCR firing to shorten the SCR's recovery time and provide an optimized ignition pulse train for the present invention.

Another feature of the present invention is to advantageously use the MPCDRC ignition system and an EFFL plug with the present coil invention and provide many spark pulses per ignition firing, e.g. 10 to 20 at low RPM, dropping to preferably about 3 closely spaced (e.g. 250 usec) pulses at 6,000 RPM.

Another feature of the present invention is to supply enough such spark pulses per firing to ignite at least about half of the toroidal volume of the EFFL plug at low RPM engine operation.

Another feature of the present invention is to provide a variable spark pulse timing with gradually increasing time between pulses with subsequent pulses, increasing by a factor of about two, i.e. initial time between pulses of, say, 250 usec which increase to 400 usec at the end of the tenth pulse, and to say 500 usec at the end of the 15th pulse if such a long pulse train is used.

Another feature of the present invention is to use such a variable, long duration pulse train to ignite a large volume.

Another feature of the present invention is to make the core halves of butted "E" cores with preferably one similar outside dimension and the primary comprised of thin, low loss laminations and the secondary core designed with a smaller center post diameter so that it provides a large height of its winding window.

Another feature of the present invention is to produce an off-set between the primary and secondary cores by, for example, using a larger lamination stack in the primary core in a laminated type core, so that the off-set allows for adjustment (increase) of the primary leakage inductance Lpe (and primary inductance).

Another feature of the present invention is to make the core of a double internal diameter single "E" core or pot core with an "I" bar (for an "E" core) or cylindrical cap (for the pot core).

Another feature of the present invention is to use a separate outer casing for the core material of a pot core type design which is not easily breakable, e.g. plastic with ferrite loading, NiFe or SiFe metal tape wound in cylindrical tubular form, and others, to be used to more advantageously select the dimensions of parts so that structural factors can be neglected, i.e. so that thin outer tubes can be used, and by using high saturation flux density metal tape to be further able to make the outer sections of even a thinner wall.

Another feature of the present invention is to use the coil invention in a distributor type ignition of the MPCDRC type in which more than one (set of) SCR(s) is provided which are fired alternatively with each ignition trigger to relieve the thermal stress on the SCRs at high RPM and in engines with many cylinders.

Another feature of the present invention is to provide one set of SCRs per two to four cylinder of an engine, so that, for example, two sets are provided for a standard V-8 engine, three to four sets for a high speed 12 cylinder engine, and so on.

Another feature of the present invention is its special suitability for assuring ignition under otherwise problematical conditions imposed by large volumes, cold ambient, alcohol fuels, engine wear, and non-optimum tuning and the like.

Another feature of the invention is its contribution, generally, to transformer arts, apart from the ignition context.

Another feature of the present invention of the side-by-side winding placement is to use two different magnetic materials for each winding core half, a low loss (preferably ferrite) material for the half in which the primary wire is wound and a low cost (generally higher loss) high magnetic saturation material, e.g. Silicon Iron for the half on which the secondary winding is wound.

Another feature of the present invention using separate windings is to divide into two parts the separate high leakage inductance Lpe primary winding of the coil, a first part (Lpel) that is coupled to the secondary winding through either very low leakage concentric windings or side-by-side windings comprising the primary winding of a compact transformer (coil), and a second part that is contained in a separate core comprising a choke of leakage inductance Lpe2, wherein generally Lpe2 is greater than Lpe1.

Another feature of the present invention is to provide two separate primary windings of leakage inductance Lpe1 and Lpe2 to decouple part of the primary leakage magnetic flux from the secondary winding to minimize secondary winding AC losses and losses of the core supporting the secondary winding so that smaller, lower cost, high magnetic saturation, higher loss material, e.g. Silicon Iron (SiFe), can be used for the compact coil.

Another feature of the present invention is to provide simple, low cost forms of distributorless ignition by utilizing a single leakage choke of inductance Lpe2 with the required number of low leakage inductance compact coils (of leakages Lpe1i) which can be made very small and cheap through the use of SiFe laminated magnetic core material.

Another feature of the present invention is to utilize an alternative form (topology) of discharge circuit made possible by the presence of the large (isolation) choke of the preferred recharge circuit to develop a particularly simple form of distributorless ignition system.

Another feature of the present invention is to use the advantages of the two part primary winding coil structure to build a particularly small compact coil with high saturation flux density core material, such as very small particle sized Powdered Iron or Silectron or other material which can be easily formed into shape, wherein said small coil can be mounted over a spark plug for a particularly compact overall design.

The objects of the invention include realization of the foregoing features.

Other features and objects of the invention will in part be obvious and will in part appear hereinafter; the foregoing enumeration is not exhaustive. The invention accordingly comprises the apparatus possessing the construction, combinations of elements and arrangements of parts, and the process including the several steps and relation of one or more of such steps with respect to each of the others, exemplified in the following detailed disclosure and the scope of the application of which will be indicated in the claims.

For a fuller understanding of the nature, features, and objects of the present invention reference should be made to the following detailed description taken in connection with the accompanying drawings.

BRIEF DESCRIPTION OF THE DRAWINGS

FIG. 5 is a side view cross-section of a preferred embodiment of the coil invention using a modified E-type core made of ferrite, thin silicon iron or nickel-iron laminations, or other material.

FIG. 5*a* is a table of preferred dimensions for the preferred coil design of FIG. 5.

FIG. 6 is another side view cross-section of the coil design of FIG. 5 including components of a CD circuit which are preferably used with the coil.

FIG. 6*a* is a table of preferred dimensions for the preferred coil design of FIG. 6.

FIG. 7 is a side view drawing of a preferred embodiment of the coil invention featuring a pot core comprised of two different magnetic materials, a single central ferrite core piece with single ferrite end cap, and preferably non-ceramic outer material such as metal tape (SiFe, NiFe) wound in a cylindrical tube or plastic or other semi-rigid ferrite loaded material comprising a tube for the return magnetic flux.

FIG. 7*a* is a table of preferred dimensions for the preferred design of FIG. 7 which is particularly compact and suitable for a distributorless ignition system.

FIG. 11 is an equivalent circuit of the coil and the secondary circuit showing features of the preferred spark plug wire of FIG. 10.

FIG. 12 is a secondary circuit attenuation or resistive impedance curve for the preferred spark plug wire of FIG. 10.

FIG. 13 is an approximately to-scale drawing of a side view cross-section of a preferred embodiment of the coil invention designed for a pot core.

FIG. 13*a* is a table of preferred dimensions for the preferred coil design of FIG. 13.

FIG. 14 is a half side view cross-section of a preferred embodiment of the coil invention showing an alternative means of constructing the magnetic core and winding the secondary turns.

FIG. 15 is a variant of a standard form of high leakage inductance coil winding modified to more optimally use the design criteria of the present invention.

FIG. 23 is an approximately full scale drawing of a top view of a preferred embodiment of a coil assembly of a distributorless ignition for a four cylinder engine.

FIGS. 23*a*, 23*b* are full scale drawings of side views of preferred compact coils made from laminations (scrapless design) and the single leakage inductor made from ferrite material.

DESCRIPTION OF PREFERRED EMBODIMENTS

Figure 1:
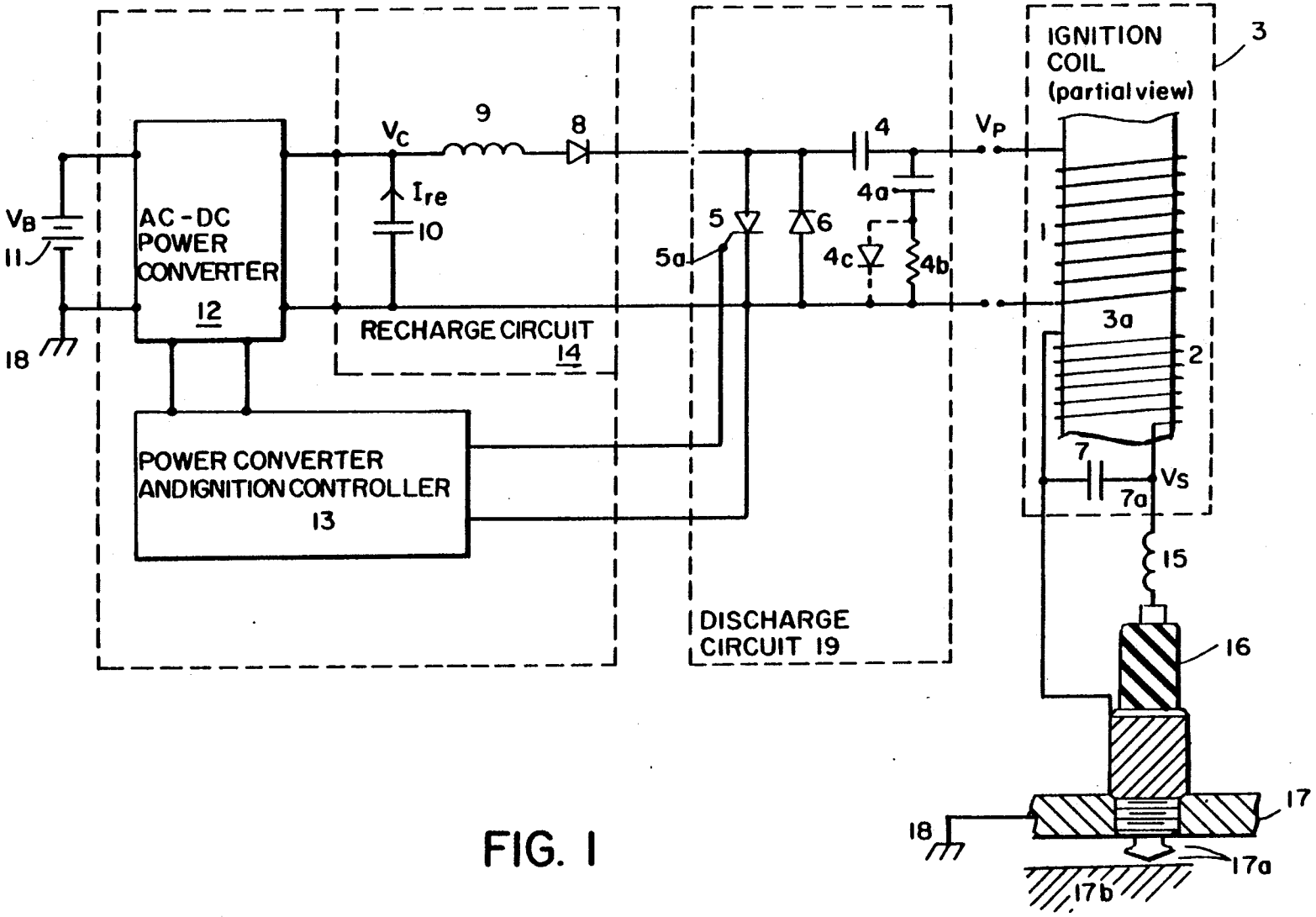
FIG. 1 is an idealized view, partially in block diagram and partially schematic, of a preferred embodiment of a complete system designed for more optimally using the present coil invention for internal combustion engine applications, including an energy delivery circuit of the capacitive discharge type with the preferred recharge circuit and preferred EFFL spark plug.

FIG. 1 is a block diagram of a preferred ignition system circuit of the capacitive discharge (CD) type 19 which can advantageously make use with the coil invention 3, which is shown in a schematic partial view form. The ignition is typically powered by a battery 11 of voltage VB (typically 6, 12, or 24 volts) and a DC-DC power converter 12 used to raise the battery voltage to a more usable value Vp, typically in the range of 200 to 600 volts. Preferably, converter 12 is of the high efficiency type disclosed in U.S. patent application Ser. No. 179,953 or an improvement thereof. The system includes controller means 13 to control both converter 12 and the discharge circuit 19, and preferably also includes a recharge circuit 14 of the type disclosed in U.S. patent application Ser. No. 131,948, connected at the output of the converter 12. Spark plug means 16 is preferably of the annular gap type disclosed in the above patent application. Essentially, the coil invention was developed to provide an improved coil design for the optimized ignition circuit disclosed in above patent application 131,948, and to further improve the performance of the ignition.

For the purpose of specification of the various parameters and to facilitate the disclosure, the following definitions are made:

"equal to X" implies X+ or −10% of X;

"approximately (equal to) X" implies X+ or −25% of X;

"about (equal to) X" implies X+ or −50% of X;

"of the order (of magnitude) of X" is as per convention to be a value between 0.1 of X and 10 times X.

To further facilitate the disclosure, discharge capacitor 4 of the CD circuit 19 and recharge capacitor 10 will be taken to be 400 volt capacitors with values of about 6 uF and 3 uF respectively (charged to approximately 350 volts), it being understood that CD circuits in part are designed according to their total capacitive stored energy, which in the present application is preferably about ½ joule, designating a high power, high energy system capable of utilizing the voltage doubling principle first disclosed in U.S. Pat. No. 4,677,960. Thus, if a similar system is designed with, say, 600 volt capacitors, then for the same stored energy one would reduce the size of the capacitors to about 3 uF and 1.5 uF respectively. Likewise, in cases where a design parameter is proportional to the voltage Vp to which capacitor 4 is charged, e.g. number of turns Np of primary winding 1 of coil 3, the value of that design parameter will accordingly be modified (increased proportionally for Np with the voltage Vp).

In operation, capacitor 4 is initially charged to a voltage Vp of approximately 350 volts by means of the DC-DC converter 12. Upon ignition firing, controller 13 applies trigger signals to one or more gate **5*a* of preferably one or more SCR switching means 5 to discharge said capacitor across primary winding 1 of coil 3. Current flows sinusoidally through capacitor 4 and primary winding 1 with a preferred period of about 100 usecs, initially through SCR 5 and then through diode means 6, with SCR 5 preferably recovering at the end of the first approximately 100 usec period. Snubber means comprising capacitor 4*a* and resistor 4*b* are preferably provided to safeguard recovery of SCR. Diode means 4*c* may be used as part of the snubbing circuit to reduce snubber losses and resistor 4*b* limits the snubber current to the SCR upon SCR turn-on. Other lossless snubber means may also be used. Typically, capacitor 4*a* is 0.05 to 0.2 uF and resistor 4*b* is a few ohms or less i.e. can be eliminated. Fast SCR turn-off circuit of the type disclosed in detail in patent application Ser. No. 131,948 is preferably used to speed up the recovery of SCR means 5**.

Upon SCR triggering, output terminal **7*a* of secondary winding 2, of turns Ns and of turns ratio N (N=Ns/Np) of approximately 50, rises to a voltage sufficient to breakdown spark gap 17*a* of plug 16** and to produce a sinusoidal spark current of preferably peak value Ip of about 2 amps and frequency of about 10 kilohertz (kHz), where:

$$Ip=2*pi*f*Cp*Vp \quad [1]$$

where pi=3.142;

f=frequency of oscillation of discharge circuit 19, f=1/[(2*pi)*SQRT(Lpe*Cp)];

Cp=capacitance of discharge capacitor 4;

Lpe=leakage inductance of primary winding 1.

The symbol "SQRT" is defined to mean the "square root of" the quantity following it.

For the 10 kHz operation and the preferred value Cp of approximately 6 uF, Lpe should have a relatively high value (given the small number of primary turns Np) of approximately 45 microhenry (uH), which is one of the requirements that led to the development of the present coil invention. In addition, the ignition should be preferably operated in a multi-pulsing or multi-strike mode in conjunction with the recharge circuit 14, made up of capacitor 10 of capacitance Ce equal to ¼ to ½ the value (Cp) of capacitor 4, choke inductor 9 of inductance about 20 mH, and diode 8.

A key feature of the coil invention is based on the recognition that the open circuit, high voltage (e.g. approximately 30 kV) coil operating condition is different from the short circuit sparking operating condition, which leads to a preferred side-by-side windings 1 and 2 around the core **3*a*** shown schematically in the figure.

Moreover, the coil design requires minimization of coil secondary output capacitance 7, both from the perspective of coil core 3*a* saturation and peak output voltage Vs. Spark plug 16 preferably has a moderate capacitance of approximately 40 picofarads (pf) and annular and/or forward firing average spark gap 17*a* of about 0.1 inch with respect to the cylinder head 17 or piston 17*b* connected to the chassis ground 18.

For clarity, it is pointed out that while the coil invention to be disclosed is a well defined, stand alone device, it provides great benefit when particularly used in conjunction with the circuit shown in FIG. 1, i.e. the circuit and coil complement each other. This circuit was disclosed as a circuit for more optimally providing the benefits of the new approach to ignition which also advantageously makes use of the present invention, which circuit is disclosed in patent application Ser. No. 131,948 and in the 1989 SAE paper No. 890475, "A New Spark Ignition System for Lean Mixtures Based on a New Approach to Spark Ignition", by Michael A. V. Ward.

Figure 2A:
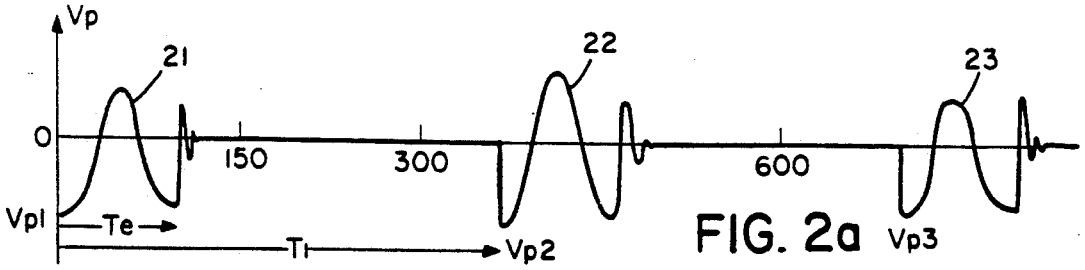
FIGS. 2*a* and 2*b* are the primary voltage and recharge current waveforms respectively of a preferred MPCDRC ignition using the present coil invention.
Figure 2B:
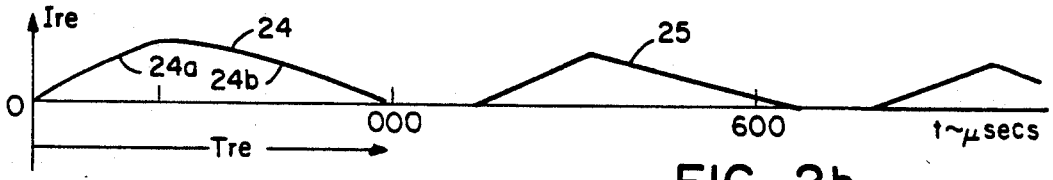

FIGS. 2*a* and 2*b* depict the primary voltage waveforms 21, 22, and 23, and the recharge current Ire waveforms 24 and 25 of the preferred embodiment of the ignition circuit of FIG. 1 operated as a multi-pulsing system defined herein as an MPCDRC ignition system. Preferably, as stated, the discharge period Te is approximately 100 usecs and the complete single pulsing period Ti (where the subscript "i" represents the ith pulse) is two to five times Te, preferably approximately three times (approximately 300 usecs) for the first few pulses and preferably gradually increasing to, say, 500 usecs after the tenth pulse (if ten or more pulses are used in a single ignition firing train, as may be preferred at low RPM engine conditions). Typically, as a result of the recharge circuit (14) operation initial voltage Vp2 of the second pulse will be approximately equal to or greater than Vp1.

In operation, the recharge circuit 14 conducts current Ire through choke 9 during the 100 usec discharge period Te, designated as 24*a*, storing magnetic energy in the choke 9, which is subsequently delivered (phase 24*b*) to capacitor 4 such that preferably the current Ire has reached zero at approximately the time periods Ti, as would be achieved with the values of the various parameters already disclosed.

Figure 3A:
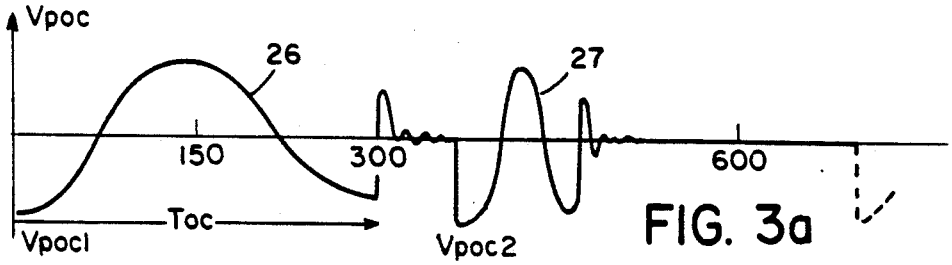
FIGS. 3*a* and 3*b* are the primary voltage and recharge current waveforms respectively of a preferred MPCDRC ignition using the coil invention which is further designed in conjunction with the spark pulse timing to provide a higher voltage second spark pulse should the first pulse not fire the spark gap.

FIG. 3*a* depicts the primary voltage waveforms 26 and 27 for the particular case where the first pulse of peak primary voltage Vpoc1 is not high enough to produce sufficient secondary voltage to fire the gap, and wherein the primary inductance Lp is selected such that the misfire waveform 26 of period Toc is less than T1 to allow recharge of capacitor 4 before the second pulse, preferably to an even higher voltage Vpoc2 than the normal voltage Vp2 to insure firing of the gap on the second pulse. Since the discharge period Toc is defined by the primary inductance Lp and not the primary leakage inductance, then the requirement is that Lp/Lpe be less than (T1/Te)**2, preferably less than by about 50 usecs. At the same time, Lp is preferably approximately ten times Lpe to provide a high coupling coefficient k, e.g. k=0.95, where:

$$k = \mathrm{SQRT}[1-(Lpe/Lp)] \qquad [2]$$

Values of 45 uH and 400 uH for Lpe and Lp respectively give a period Toc of 300 usec for Te of 100 usec, which is satisfactory for an initial period T1 of 350 usec (which may preferably be set somewhat higher than the next few periods T2, T3, T4, which could be set at, say, 250 to 300 usecs). However, because the core may part saturate during the lower frequency misfire period, measured period Toc may be less than theoretical, which can be taken to advantage by not requiring Lp to be as small as otherwise is required (and hence k can be higher).

Figure 3B:
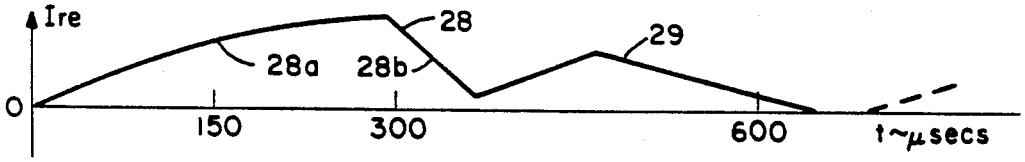

FIG. 3*b* depicts the first two recharge current waveforms 28 and 29, particularly showing the longer initial period 28*a* corresponding to the period Toc and the short (about 50 usec) period 28*b*. Note that for the case wherein waveforms of recharge current Ire are back to back, i.e. no zero current dead time exists during the multi-pulsing period, diode 8 may be eliminated.

Figure 4:
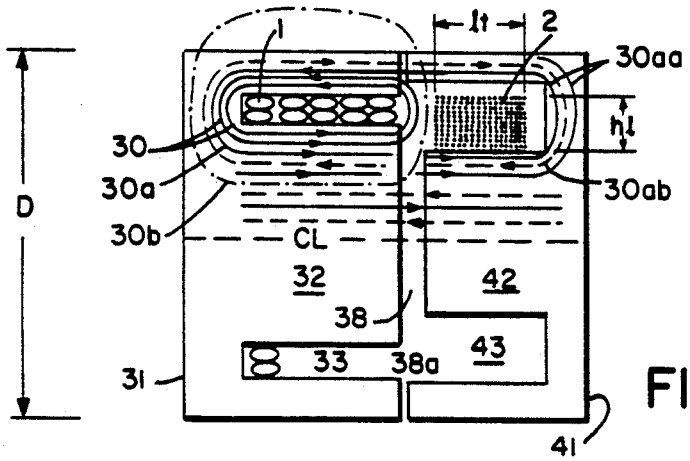
FIG. 4 is a cross-sectional side view of the coil invention featuring the two differing core halves containing each winding separately and showing magnetic flux density lines.

FIG. 4 depicts a cross-sectional side view of a preferred embodiment of the coil invention featuring the two differing core halves 31 and 41 containing respectively the primary 1 and the secondary 2 windings separately and showing magnetic flux density lines 30, 30*a*, 30*aa*, 30*ab*, 30*b*. In this preferred embodiment the primary winding 1 comprises two layers of about 10 turns total of preferably Litz wire wound around a center post 32 of a pot core, an E type core, or similar core, and the secondary wire comprises wire 2 wound on the other center post 42 with about 500 turns (turns ratio N of approximately 50 for assumed use of the Doubling principle). Diameter of wire of secondary winding 2 is about one half the skin depth (for the operating frequency of approximately 10 kHz) and wound in an approximately square winding and preferably, if practical, with a maximum ratio of height h1 to width of winding 1t so as to minimize AC losses and winding capacitance. A gap 38 may be included to allow for adjustment of the primary inductance Lp to a value approximately ten times Lpe as disclosed. Note that in this and other figures the primary and secondary windings are wound in the windows 33 and 43 respectively, and are generally only shown on one half side, it being understood that in general the windings are symmetrical about the center line CL of the magnetic core 3*a*.

A main feature of the invention was to recognize that by providing a larger primary winding center post 32 (versus post 42) the magnetic flux lines 30 will preferably return across gap 38*a* to provide most of the leakage inductance Lpe (which is contained internal to the core volume) with flux lines 30*b* representing the remaining externally lying leakage flux lines. In this way it is possible to minimize the diameter of core 42 which carries the secondary winding and thus provide a maximum height h1 for a given overall core diameter D. Thus, the large number of layers of the secondary wire 2, e.g. thirty layers of #28 wire with hold-off voltage interleaving, can be accomodated, which also minimizes the number of turns per layer and the effect of the leakage flux lines 30 on the AC resistance of the secondary winding 2. For a preferred thirty three layer winding and a 33 kV maximum secondary output voltage, the maximum voltage between layers is an average of 2,000 volts which can be handled by preferably using heavy, e.g. quad, coated magnet wire for the secondary winding 2 with a few mils of insulation between layers. In addition, the secondary coil winding output capacitance Csc is minimized with the large number of layers.

Flux lines 30*a* cross gap 38 into secondary post 42 (becoming flux lines 30*aa*) to couple to the secondary winding 2. In turn, flux lines 30*ab* are induced tending to cancel flux lines 30*aa* and 30*a* to minimize the flux density in core 42, especially under spark firing conditions (closed circuit secondary winding 2).

The invention is based in part in separating out the spark firing or closed (secondary) circuit conditions from the open circuit condition. In the closed circuit condition, almost all the (uncancelled) flux lines are carried in the primary core 31 across gap 38*a*, so that in designing the primary winding based on losses and saturation flux density one can treat the primary as a stand alone choke of inductance equal to the leakage inductance and calculate the magnetic flux density B according to:

$$B = Ip*\mathrm{SQRT}[Lpe*Meff/Vm] \quad [3]$$

where Ip, the peak primary current has already been defined; Meff=Lpe/Lpair, where Meff is the effective permeability, Lpe is the leakage inductance, Lpair is the inductance of the primary winding with the core removed, and Vm is the primary core volume.

Once the primary core 31 and winding is specified based on the above formulation, then it will automatically satisfy the open circuit condition which produces a significantly lower magnetic flux density in the core because the open circuit frequency foc of oscillation is much higher than the closed circuit or sparking frequency fcc (of the preferred approximately 10 kHz). Typically, for the present invention, foc=4*fcc, as will be shown.

The design of the secondary core 42 is based on the open circuit condition. Because of foc's higher value (compared to fcc), secondary post 42 diameter can be made smaller, although the amount it can be reduced is not a simple function and will be disclosed with reference to FIG. 13, representing a design based on low saturation flux-density materials, i.e. ferrite material. The amount it can be reduced is limited by the saturation flux density Bsat of the secondary winding core material. For a high Bsat material, such as Silicon Iron, Nickel Iron, etc, the limitation is one of losses and not saturation, and since little energy is associated with the initial open circuit high breakdown voltage, one is free to pick the diameter to a suitable small value.

FIG. 5 is an approximate to-scale design based on a high Bsat material and is presented as a preferred embodiment and as a case which demonstrates features and advantages of the coil invention. The drawing is a partial top view cross-section of a preferred embodiment of the coil invention using a modified E-type core made of thin silicon iron (SiFe) or nickel-iron (NiFe) laminations, or other material, including ferrite. For the case of laminations, preferably, the laminations are 2 to 6 mil thick (1 mil=0.001") to minimize core losses at the preferred frequency fcc of approximately 10 kHz (which may in this case of laminations be lowered to, say, 8 kHz). In this and in the following figures like numerals denote like parts with respect to the previous figures.

FIG. 5*a* is a table of preferred dimensions for the preferred coil design of FIG. 5, the dimensions being "approximate" as per the definition. They can be adjusted depending on whether the application is for a distributor type or distributorless system (where smaller dimensions are preferred in the latter).

In this preferred embodiment, twelve turns of primary winding (Np) of preferably Litz wire are used in two layers. Given the window 33 width dimension W1 of approximately 0.3 inches and the length 12 of approximately 1.0 inches, twelve turns of 0.15 inch diameter Litz wire (made up of #30 wire strand) is suitable, giving a very low resistance of approximately 5 milliohms and a maximum flux density Bmax given by the alternative formula:

$$\mathrm{Bmax} = Vp/[2*pi*f*Np*A] \quad [4]$$

where A (or Ap) is the primary core cross sectional area. For the above parameters and further assuming:

f=fcc=10 kHz

Vp=350 volts gives a value for Bmax of 0.72 Tesla, which is approximately half of Bsat for NiFe and less than half of Bsat for SiFe.

The core losses are calculated in the normal way although the core volume is taken as that of the primary core half 31. For 2 to 4 mil NiFe core material the core losses may be acceptable for a high efficiency coil, defined as a coil whose core and wire (power) losses are less than the spark gap power dissipation Parc. For (2 to 4 mil) SiFe the core losses may be too high and may be reduced by increasing the winding length 12 and the number of primary turns, to say 15 turns, which also increases the leakage inductance Lpe. Value of capacitor 4 may be reduced, say, 20%.

The secondary core is designed to provide a winding window with height hs of 0.5 inch (and insulating layer of ⅛ inch, for a total dimension W2 of ⅝ inch) and a winding width 1s of 0.45", assuming ⅛ inch insulating layers on each side. Assuming quad coated #28 wire (diameter 0.016 inches) and 0.004 inch insulation between layers, for a 600 turn secondary winding (turns ratio N of 50 for Np=12), one can easily accomodate 24 turns per layer and 25 layers, for low AC losses and low output capacitance Csc.

The dimensions given in FIG. 5*a* are consistent with the above disclosure excepting that the two legs of primary core 31 are shown as 0.45 versus 0.5 inches, or 10% less than half of diameter a2, arrived at on the basis of experimental measurements.

FIG. 6 shows the other side view of the coil excepting that it includes a high voltage tower 48 with the secondary high voltage end of the wire 47*a* brought out as shown to terminal 49*a*. In addition, in this embodiment the secondary core section 42*a* is off-set from the primary core section 32*a* to accomodate the discharge circuit made up of capacitor 4 and the other components designated in total as 60. Typical approximate dimensions are given in FIG. 6*a*.

One of the features of this coil design is its higher efficiency (for a given volume), as compared with the high efficiency coils disclosed in U.S. patent application Ser. No. 131,948. Taken with the more efficient spark delivery circuit which includes the recharge circuit 14 and the preferably high efficiency power converter disclosed in patent application Ser. No. 179,953, one can operate the ignition with a larger number of pulses per spark firing, e.g. 8 to 16 pulses at low RPM without undue battery current draw.

FIG. 7 is an approximately to-scale cross-sectional side view of a preferred embodiment of the coil invention in a pot core configuration with the secondary post 42*b* area As approximately one half the area Ap of the primary winding center post 32*b* and with typical dimensions for an especially compact design (e.g. for a distributorless ignition) given in FIG. 7*a*. This design is based on the example worked out in "Case 6" with reference to FIG. 13 wherein a high frequency of approximately 20 kHz is assumed for the discharge frequency fcc.

In this design is depicted one of several possible practical designs for manufacturing the pot core, wherein center posts 42*b* and 32*c* and the end plate 32*c* of the primary winding side are made of one easily moldable ferrite core piece. The secondary winding cap 42*c* is a separate piece, as are the outer cylindrical tube sections 36 and 46. This design lends itself to designing the outer section 46 of thin material based on the requirements of the magnetic design, as presented with reference to FIG. 13, and not on structural principles, which would require sections 46 and 42*c* to be of thicker wall to prevent breakage.

Preferably, material comprising cylindrical tubular sections 36 and 46 be of non easily breakable material, including and not limited to plastic loaded with ferrite to give as high a permeability as practical (e.g. relative permeability of about 100), metal tape wound to the appropriate thickness, recognizing that very thin layers (e.g. ¼ to ½ that given in the table of FIG. 7*a*) may be possible if SiFe or NiFe tape is used because of their very high values of saturation flux density Bsat.

FIG. 7*a*, as already stated, gives suitable design values for a small coil design. By following the principles presented with reference to FIG. 13, one can modify these parameters, the main feature being presented here is the novel way of fabricating the core, including the application of more than one magnetic material being used to advantage.

Figure 8:
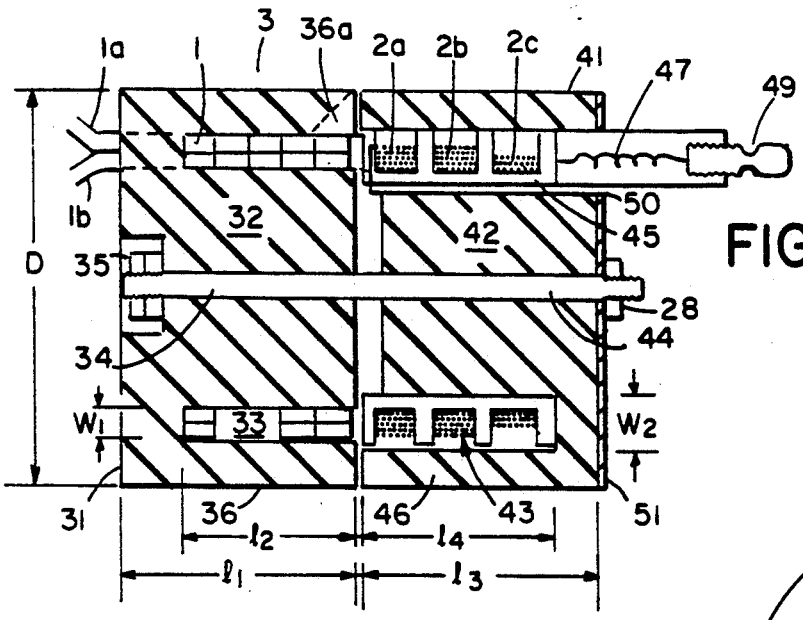
FIG. 8 is a detailed side-view drawing of an approximately to-scale embodiment of the coil invention in a pot type core using a three-sectioned, low output capacitance secondary winding.

FIG. 8 is a detailed drawing of an approximately to-scale embodiment of the coil invention in a pot type core using a three-sectioned, 2*a*, 2*b*, 2*c*, low output capacitance secondary winding wound on a dielectric frame 45. Such a winding has an inherently higher AC resistance and is therefore more suitable for Litz wire.

In this design, the dimensions 11, 12, and D are similar to those of FIG. 5 while dimensions 13, 14 are somewhat longer as is diameter of secondary center post 42, which is assumed to be of ferrite material in this embodiment. The two core halves 31 and 41 (and end cap 51) are held together by nut and bolt section 35, 34, 44, 28. The two layer primary winding 1 is brought out at the back surface with leads 1*a*, 1*b*. The secondary winding is conveniently brought out through tower 48 by means of lead 47 which is connected to output tip 49. Secondary ground return 50 is brought out adjacent to the tower and may be terminated on the ground plate 51. In such side-by-side bringing out of the secondary wire ends 47 and 50, the secondary output capacitance Csc of the coil is available for producing a capacitive spark without being impeded (which would otherwise occur if ends 47 and 50 were brought out through separate holes in the magnetic core material).

This cylindrical pot core design, as the one depicted in FIG. 7, features particularly low EMI and compact design and may be particularly suited for distributorless ignition, especially if the overall output capacitance Cs can be kept at, say, 75 pF (30 pF for coil, 25 pF for the wire, 20 pF for the spark plug), and even lower capacitance Cs (e.g. 50 pF) if the coil is directly mounted on the spark plug.

Figure 9:
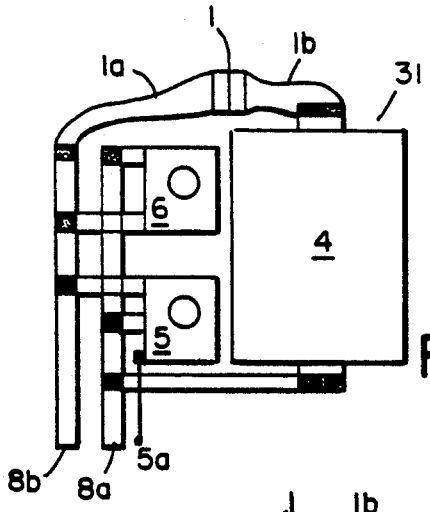
FIG. 9 is a drawing of a possible compact orientation of a CD circuit used with the coil invention.

FIG. 9 depicts a typical discharge circuit layout designed to conveniently mount to the back side of primary core 31 (see FIG. 8) to minimize the length of the primary wire 1. Conductor sections 8*a* and 8*b* carry the high voltage and return to the 350 volt supply, preferably through the recharge circuit 14. Wire 5*a* is the gate of the SCR 5, and component 6 is tab type high current diode means. Side-by-side mounting of the SCR(s) 5 and diode 6 shown makes for good layout of their anode and cathode terminals. Capacitor 4 is preferably of rectangular shape (of preferably 3 to 6 uF value) with the larger cross-section shown in the figure.

Figure 9A:
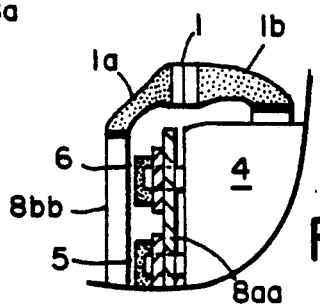
FIG. 9*a* is a fragmentary, partial view of a positioning of an SCR and diode of a CD circuit used with the coil invention.

FIG. 9*a* is a fragmentary partial view of the discharge circuit of FIG. 9 in which the SCR(s) and diode are mounted vertically along conductor 8*aa* which also serves as a heat sink. While not specifically shown, SCR 5 and diode 6 anode and cathodes can be reversed as per the layout of FIG. 1 so that the heat sink tab of the case of the devices are at ground potential, the output of converter 12 is at a negative polarity, diode 8 (if present) is reversed, and isolated trigger means are provided for SCR gate 5*a*. Magnetic sense of primary winding should be accordingly reversed to provide the correct polarity of the high voltage output Vs for spark gap breakdown.

With regard to the "correct" high voltage polarity, it has been discovered for the present application of a preferred spark plug with annular gap, a positive, not conventional negative high voltage initial breakdown polarity Vs is preferred because of the reduced fouling of the plug tip insulator with positive polarity.

With reference to FIGS. 8, 9, 9*a*, it should be noted that the primary leads 1*a*, 1*b* could also be brought out on the opposite side of that shown in FIG. 8 along the notched corner 36*a* of the outer core section 36 of the primary (winding) half core 31 along a lengthwise, if necessary, notched section of the outer section 46 of the secondary half core 41. Such notched length, for example, is standard in the Ferroxcube core part number 6656PL00-3C8. In such an embodiment, the discharge circuit of FIG. 9 would preferably be placed on the surface defined by plate 51 near the high voltage tower 48 to make for a particularly compact design.

Figure 10:
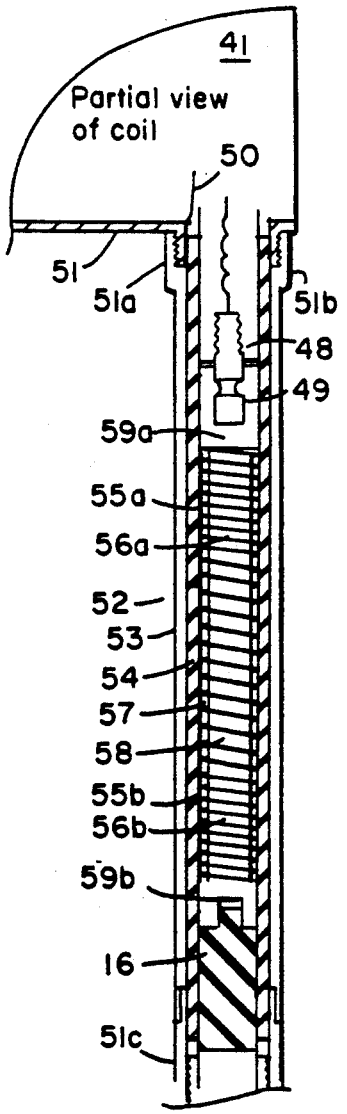
FIG. 10 is a preferred spark plug wire to be used especially with a distributorless form of the coil invention.

FIG. 10 depicts a preferred design of spark plug wire particularly well suited for use with a distributorless form of ignition in which the coil is directly connected to the spark plug 16. Spark plug wire 52 has a ground casing 53, preferably of flexible mesh type and high voltage insulation 54 preferably of low dielectric constant to minimize the wire capacitance to preferably keep it below 50 pF. The center conductor is preferably wound in a helix as is commonly done with EMI suppression wire, excepting in this case the two ends of the helix winding 55*a*, 55*b* may comprise more tightly wound sections around an air cores 56*a*, 56*b* which do not saturate. Central winding section 57 preferably is wound around ferrite core material 58 which is preferably powdered high frequency ferrite material encapsulated in rubber or other preferably flexible material used for such purposes. The outer casing is terminated in threaded tubes 51*b*, 51*c* or tubes comprised of spring type material which can be mounted on the spark plug shell and onto a protruding section 51*a* of the ground plate 51 which is mounted (and grounded) onto the face of the core secondary 41 of the coil. Clips 59*a*, 59*b* are provided for connecting the center high voltage carrying conductor.

Such a spark plug wire shown in FIG. 10 may also be used in an unshielded form as a spark plug wire for distributor ignition or as a shielded King lead (coil wire) in a distributor type ignition with unshielded spark plug wires.

FIG. 11 depicts an equivalent circuit of the coil 3 and its secondary circuit including the wire of FIG. 10, and a spark plug of capacitance Csp (16*a*) and spark gap 17*a*. In this preferred embodiment, use is made of the coil capacitance Csc (7) and the distributed capacitance (not shown) of the wire 52 to allow the energy stored in them prior to spark breakdown to be delivered with minimum attenuation to the spark gap. These capacitances are designed preferably to be of low value e.g. 20 to 40 pF each, but when taken together with the plug capacitance provide approximately in total 120 pf, a design value preferably not to be exceeded as it will otherwise significantly compromise the peak output voltage, as discussed in detail with reference to FIG. 13.

In U.S. patent Ser. No. 4,774,914, FIG. 2*a*, there is disclosed the high frequency spark currents due to the discharge of the plug capacitance Csp, and the moderate frequency spark current (5–30 MHz in the present case) due to discharge of the coil (Csc) and wire distributed capacitances which are moderated by interposing the inductances 15*a*, 15*b*, 15*c*. The total wire inductance, shown as air core inductances 15*a*, 15*c* (of values Ls1) and ferrite core inductance 15*b* (value Ls0) of total value of about 10 uH, act to tune and lower the frequency of discharge of coil capacitance to 5–15 MHz and to lower the peak currents to about 20 amps. Inductances 15*b* and 15*c* act to tune the distributed capacitance to a somewhat higher frequency value but preferably below 30 MHz.

FIG. 12 depicts the preferred secondary circuit attenuation or resistive impedance curve of the combination of inductances 15*a*, 15*b*, 15*c* of the preferred wire of FIG. 10 as a function of frequency, where inductance 15*b* uses high frequency core material, e.g. Ceramic Magnetics material C2075, Fair-Rite Material 65, etc. As is seen, in the desired frequency range of 5–15 MHz, the attenuation is very low, approximately 1 ohm, the typical maximum preferred value of the secondary wire DC to low frequency (10 kHz) resistance. At 30 MHz the attenuation is high and rising rapidly to become and remain high through the microwave range.

The complete disclosure of the invention, which specifies the design criteria for the secondary magnetic core half, is now presented with reference to FIGS. 13 and 13*a*.

FIG. 13 is an approximately to-scale drawing of a side view cross-section of a preferred pot core configuration of the coil invention, with a secondary center post 42 area. As approximately one half the primary center post 32 area Ap with typical approximate dimensions given in the table of FIG. 13*a* for the preferred application using a 400 volt, 3 to 6 uF discharge capacitor (4). Preferred primary turns Np is approximately 10 turns of approximately #10 Litz wire and turns ratio N is approximately 55 for a 33 kV peak output voltage Vs). Preferably, as per the parameters given in FIG. 13*a*, the secondary winding is made up of an average of 22 turns (Nt) per layer and approximately 25 layers N1 for low secondary winding 2 AC resistance Rsac and low output capacitance Cs, with the secondary wire comprised preferably of approximately #28 quad coated wire. Note that the designation "approximately" applied to a wire size shall be interpreted as the wire diameter of the specified wire size plus or minus 25% of the diameter, so that "approximately" #28 wire size (0.0125 OD copper) means between #30 and #26 copper wire.

Typically, for the overall dimensions shown, winding width W1 is approximately 0.3" to accommodate two layers of approximately No. 9 Litz wire, and W2 is approximately 0.6", i.e. W2 is about twice of W1. Winding length 12, shown as 0.9" in FIG. 13*a*, is varied from that nominal value to accomodate more or less number of turns and/or larger or smaller diameter primary wire.

The design criteria for the secondary circuit (and entire coil) begins with a derivation for the magnetic flux density Bs(t) in the secondary core half of core cross-sectional area As. The derivation for specifying the magnetic flux density Bs(t) as a function of time is obtained by taking the time integral of the integral form of Faraday's law and making Bs(t) the subject:

$$Bs(t) = (1/Ns*As)*\int_0^t Vs(t)dt \qquad [5]$$

and using for Vs(t) the expression disclosed in U.S. Pat. No. 4,677,960 (as V2(t)) disclosed as part of the voltage doubling principle:

$$Vs(t)=[k*N*Vp/(1+(N**2)*Cs/Cp)]*[1-\cos(Ws*t-)] \qquad [6]$$

Substituting and integrating, we obtain:

$$Bs(t)=[k/UF]*[Vp/(2*pi*foc*Np*As)]*[x-\sin x] \qquad [7]$$

where $$x=Ws*t$$

$$Ws=\mathrm{SQRT}[UF/(Lpe*(N**2)*Cs)]$$

$$Ws=2*pi*foc$$

$$foc=fcc*\mathrm{SQRT}[UF/(UF-1)] \qquad [8]$$

$$UF=1+(N**2)*Cs/Cp \qquad [9]$$

where UF, the unity factor, is approximately (and greater than) equal to one, e.g. 1.1, for the present case wherein the Doubling principle is being used, and k is approximately (and less than) equal to one, e.g. 0.95. The expression for Bs(t) can be easily referenced to Bmax which has to be initially evaluated in designing the coil, giving:

$$Bs(t)=[k/UF]*[(fcc/foc)*(Ap/As)*Bmax]*[x-\sin x] \qquad [10]$$

$$Bs(t)=Bs(t0)*[(1/pi)(x-\sin x)] \qquad [11]$$

$$Bs(t0)=pi*(k/UF)*(fcc/foc)*(Ap/As)*Bmax \qquad [12]$$

$$Vs(t)=[k*N*Vp/UF]*[1-\cos x] \qquad [13]$$

$$Vs(t0)=2*k*N*Vp/UF \qquad [14]$$

where Ws*t0=pi, i.e. where t=t0 corresponds to half a wavelength of the open circuit oscillation (and the time that Vs(t) takes on its maximum value).

For ease of discussion, there is assumed the typical values for the present application of this invention, k=0.95, UF=1.1, which gives approximately:

$$foc=3.3*fcc;\ [k/UF]=0.86$$

Substituting in the above, gives:

$$Bs(t0)=pi*(0.86/3.3)*(Ap/As)*Bmax$$

$$Bs(t0)=0.82*(Ap/As)*Bmax$$

$$Vs(t0)=1.7*N*Vp$$

which now require interpretation, and will be given with reference to several cases of interest.

CASE 1: As a first case, the Voltage Doubling coil designed along conventional lines wherein As=Ap is considered. In this case, the value of the peak magnetic flux density Bs(t0) (at the time of peak output voltage Vs) is given by:

$$Bs(t0)=0.82*Bmax$$

and for the preferred Doubling principle value of Vp=350 volts, N is taken in this example to equal to 50 to obtain:

$$Vs(t0)=30\text{ kV}.$$

Inspection of the above reveals that with the standard types of coil design used in conjunction with the Doubling principle, for the required peak output voltage of approximately 30 kV the magnetic flux density under the open circuit conditions is somewhat less and about equal to the value Bmax for the closed circuit or spark firing condition. Hence, for the case of ferrite core designs wherein the limitation is the core saturation, there superficially appears to be little motivation for a new design.

For the present application we seek a high leakage inductance and compact high efficiency coil design. High leakage inductance can be attained by a side-by-side winding. The area Ap is defined (limited) by Bsat for ferrite cores, and by core losses for high Bsat materials (e.g. SiFe, NiFe, etc). If we could reduce the diameter or area As of the secondary winding so that a wider, e.g. two-fold wider winding window 1s was provided for the wider space taken up by the secondary winding, then a very compact design can be achieved. But for area As not equal to are Ap (based on the above values of k, UF), we have:

$$Bs(t0)=0.82*(Ap/As)*Bmax$$

If we choose As to be approximately half the value of Ap for the typical preferred condition for a compact side-by-side winding with the same overall diameter D, as disclosed in FIGS. 4, 5, 6, 8, 13, and 14, then Bs(t0) becomes:

$$Bs(t0)=1.64*Bmax$$

Hence, we see that for designs based on high Bsat materials, e.g. SiFe, NiFe, etc., where core loss is the predominant design criterion for high efficiency coils (based on the Voltage Doubling principle), and hence wherein the value of Bmax must be limited to less than half the value of Bsat, then the condition that Bs(t0) be less than Bsat is automatically satisfied, and the designs as presented with reference to FIGS. 5 and 6 are complete and satisfactory.

CASE 2: A design for laminated 4 mil SiFe as per FIG. 5 is developed below:

Vp=350 volts
Cp=5 uF
Cs=180 pF
fcc=10 kHz;
foc=30 kHz, i.e. UF=1.1
Np=13;

We require that Vs(t0)=30 kV, and as per the Voltage Doubling principle of U.S. Pat. No. 4,677,960 as further specified in U.S. patent application Ser. No. 131,948 in an equation form for specifying N, and as further modified here to account for the fact that the coupling coefficient k is not exactly 1.00 and UF is not exactly 1.00, we can obtain the turns ratio N for given values of Vs(t0) (simply designated as Vs) for given values of Vp, Cs, Cp:

$$N=[UF/k]*[Vs/2*Vp]*[1+(\tfrac{1}{2})*(Cs/Cp)*(Vs/Vp)**2]$$

$$N=[1.15]*[30{,}000/700]*[1.092]=1.15*47$$

$$N=54$$

$$Ns=700$$

and

UF=1.1 as assumed earlier
Ap=1 square inch
Bmax=0.62 Tesla
As=0.5 square inch
Bs(t0)=1.0 Tesla and hence a satisfactory design is arrived at, recognizing that for the above values of paramaters the core loss, which is based on Bmax and Vp (primary core volume), are comparable to the wire losses, assuming approximately #9 primary Litz wire (with #27 to #33 wire strands) and approximately #28 secondary single conductor wire (i.e. #30 to #26 according to the definition of "approximately").

For the case of ferrite cores which have a lower value of Bsat, the design criteria are more complicated. Since core losses for the ferrite material are a small fraction of the wire losses, optimal use the core material is achieved by preferably operating the core just below or at saturation Bsat (or even somewhat above saturation), and preferably using a high Bsat material such as Ceramic Magnetics Mn67 or TDK H7c4. A value of 0.45 Tesla is assumed for such materials for the value of Bsat (for the typical operating temperature of 60 degrees C).

CASE 3: For performing the analysis, we assume the dimensions given in FIG. 13*a*, which represents a preferred design for a coil of 30 kV output, with fcc=10 kHz, Vp=350 volts, Np=11, and Ap=2 square inches to give a lower magnetic flux density.

As a sub-case, we take the above parameters to obtain:

Bmax=0.39 Tesla
Bs(t0)=0.64 Tesla which we see is 0.2 Tesla above the Bsat so that the secondary core half (of area As=0.5 Ap) saturates prior to achieving the full output voltage of 30 kV.

It can be seen by reviewing the previous analysis that, just as the output capacitance Cs enters into the expression defining the Voltage Doubling principle (through UF), so it also (further) enters into the analysis for the core saturation of the secondary core half through Bs(t). To reduce Bs(t) we need, among other things, to reduce Cs to bring UF closer to unity and hence make foc as large as practical relative to fcc while maintaining sufficient Cs to provide a substantial capacitive spark.

CASE 4: As a general preferred case, it is proposed that Cs in units of pF be numerically approximately twenty times equal to Cp expressed in units of uF, i.e.

we take the preferred values for the case of Vp=350 volts:

Cp=6 uF

Cs=120 pF which represents a ⅓ reduction in Cs over the previous case. We assume the already specified value for k of 0.95, and for the remaining parameters the above values based on the primary circuit design, for now leaving the remaining secondary circuit parameters (except Cs) unspecified:

Np=11 (#9 to #11 Litz wire)

Ap=2 square inches which gives:

Bmax=0.39 Tesla where the value of Np was selected to give a leakage inductance Lpe of 40 uH, which for the capacitance Cp of 6 uF provides the preferred frequency fcc of 10 kHz. Clearly, for a somewhat lower peak secondary current (say 2.0 amps versus 2.5 amps) one can select Np=12 for Lpe of 45 to 50 uH and Cp of 5 uF (to keep fcc equal to 10 kHz, which is experimentally determined to give the SCR(s) sufficient time to recover for the operating condition of the ignition).

For the required 30 kV peak output voltage, we obtain for N:

$$N=[UF/k]*[30{,}000/700]*[1+(\tfrac{1}{4})*(120/6)*[(30/350)**2]$$

$$N=[UF/k]*[43]*[1.04]=[UF/k]*45$$

$N=50$ assuming UF=1.05 (which can be verified)

$$Ns=550$$

$$foc=4.6*fcc$$

which is 40% higher than the previous value. Substituting in the expressions for Bs, we obtain:

$$Bs(t0)=0.62*(Ap/As)*Bmax$$

For the otherwise same values (of the previous case) given in the table of FIG. 13*a*, wherein Ap=2 square inches, As=1.1 square inches, we now obtain:

Bs(t0)=0.62*1.8*Bmax

Bs(t0)=1.1 * Bmax=0.43 Tesla which in this case is below Bsat for the core material, making for a complete and satisfactory (consistent) design.

Note that the peak output voltage Vs can be increased to 33 kV by increasing the secondary turns to 600 turns which is easily achieved by designing the secondary winding with, for example, 24 turns per layer (Nt) and 25 layers (Nl).

CASE 5: A practical case of a standard Ferroxcube core (part No. 6656PLOO-3C8) is taken in which one core half behaves as the secondary core half and the other core half has a ring placed on its center post (OD 1.11") to create a large diameter center post of 1.6". Recognizing that the core is made of material 3C8 which has a Bsat of 0.40 Tesla (versus 0.45 Tesla for Mn67), a larger number of turns (Np=12 turns) is required in the primary winding. We further assume a value of Cp of 5 uF versus 6 uF to keep fcc at 10 kHz and to limit Bmax.

Below are given the various parameters:

Cp=5 uF

Cs=120 pF

Np=12

Ap=2.0 square inches

As=0.95 square inches which gives:

Bmax=0.36 Tesla

N=[UF/k]*[43]*[1.045]=[UF/k]*45

N=50 assuming UF=1.06 (which can be verified)

Ns=600 foc=4.2*fcc k/UF=0.9

Bs(t0)=0.67*(Ap/As)*Bmax=1.4*Bmax

Bs(t0)=0.50 Tesla which is above Bsat of the 3C8 material (at 60 degrees C) by 25%.

This brings us to a further important feature of this invention which allows us to correct the above problem of too high a value of Bs(t0) by other means than by increasing Bmax or the secondary core half cross-sectional area As. This can be seen by writing the equations for Vs(t) and Bs(t) in their time dependent form:

$$Vs(t)=Vs(t0)*Fv[x(t)] \quad [15]$$

$$Fv[x]=0.5*(1-\cos x) \quad [16]$$

$$Bs(t)=Bs(t0)*Fb[x(t)] \quad [17]$$

$$Fb[x]=(1/pi)*(x-\sin x) \quad [18]$$

$$x=Ws*t$$

If we differentiate Fv and Fb (designated as Fv', Fb'), we obtain:

$$Fv'[x]=0.5*\sin x$$

$$Fb'[x]=(1/pi)*(1-\cos x)$$

Evaluated at the peak value for Vs, i.e. at time t=t0 (x=pi), $$Fv'[pi]=0$$

$$Fb'[pi]=2/pi$$

and we see that, over the range of x between 0 and pi, Fv rises more rapidly than Fb. Initially, Fv rises slowly, then rapidly around x=pi/2, and slows up to a zero slope at its maximum value at x=pi; On the other hand, Fb rises slowly, and gradually increases in slope to a maximum rate of rise at x=pi. More particularly, for x=x1=0.9*pi Fv[x1]=0.975

Fb[x1]=0.80 so that if the turns ratio N is increased by 2.5% (and simultaneously foc is kept constant, i.e. SQRT(Cs/Cp)/N is kept constant), then:

Vs[x1]=30 kV

Bs[x1]=0.40 Tesla and full output voltage Vs of 30 kV is achieved even in this case by increasing the turns ratio N by only a few percent.

Note that increasing the secondary turns Ns increases UF and hence reduces foc. More particularly, since foc is approximately inversely proportional to the turns ratio N (and to the square root of the ratio Cs/Cp), then one must approximately double the value of required increase in turns ratio N (or reduce SQRT(Cs/Cp) proportional to the increase in N. More exactly:

$$Vs(t)=(N/NO)*Vs(t0)*Fv[x(t)]$$

$$Bs(t)=(N/NO)*Bs(t0)*Fb[x(t)]$$

where N is the value we have increased NO to in order to reduce Bs(t).

While we are free to choose x1 (and hence the new turns ratio N), the value X1=0.85*pi is selected as a good design value.

Fv[x1]=0.95

Fb[x1]=0.70

Increasing the turns ratio by 5% i.e.

$$N/NO=1.05$$

$$Vs[x1]=1.05*0.95*Vs(t0)=Vs(t0)$$

$$Fb[x1]=1.05*0.70*Bs(t0)=0.75*Bs(t0)$$

so that we can achieve an approximately 25% reduction in As if we select the turns ratio N so that it provides a peak output voltage Vs which is 5% above the design value Vs(t0) (assuming the secondary core does not saturate even though in reality it would).

This is an important result in that it gives additional flexibility in designing the coil of the present invention. More particularly, it suggests designing the primary core area Ap and primary winding Np for appropriate Bmax, e.g. to have Bmax approximately equal to Bsat, and suggests designing the secondary core area and winding to make use of the above phenomenon of the differing slopes of Fv and Fb, and particularly to select the turns ratio N to be 5% greater than its design peak value Vs(t0) so that As can be reduced by approximately 25%.

CASE 6: Another embodiment of the invention is one in which the small size of the coil and the design principles presented herein are advantageously made use of to develop a coil design suitable for a distributorless ignition. Preferably, a higher frequency of oscillation fcc is used, e.g. 20 kHz, achieved by using a faster turn-off SCR, or allowing the SCR to ring, etc. Ferrite core material is used because of the high frequency of 20 kHz. This higher frequency is preferably attained as follows: Ap=1 square inch Np=11

Cp=3 uF, Lpe=20 uH fcc=20 kHz and by careful design we can also achieve:

Cs=60 pF (40 pF in coil, 20 pF in plug)

N0=50

UF=1.05 foc=4.6 fcc

Vs(t0)=30 kV

In this way, the coil size can be reduced to approximately half the size of the coils disclosed, and by using a 5% higher turns ratio N (53 instead of 50) than predicted based on the time x(t0), one can further reduce the secondary cross-sectional area As than otherwise expected (by 25%).

$$As=0.42 \text{ square inches (diameter of 0.65")}$$

$$Bmax=0.39 \text{ Tesla}$$

$$Bs(x1)=0.61*0.75*(Ap/As)*Bmax$$

$$Bs(x1)=0.42 \text{ Tesla}$$

With reference to FIGS. 13, 13*a*, the same length dimensions 11, 12, 13, 14, are preferably used with the revised cross-sectional dimensions:

D=2.0"

a1=1.65, a2=1.15, W1=0.25 a3=1.75, a4=0.65, W2=0.55 and we see that appropriate dimensions are produced, especially for the winding window W2 which is maintained at a large value of approximately 0.55 inches.

Note that the above design can be implemented in the coil depicted in FIGS. 7 and 7*a*. Also, such a design may be particularly useful where a large amount of energy is required to be delivered rapidly, as in a cavity type plug of a plasma jet type of ignition. In this case even higher frequencies can be used, e.g. 30 to 40 kHz, for further size reduction and lower number of turns of primary and secondary wire. Semi-standard ferrite "E" type may easily avail themselves to this application wherein the area As of the center core of the secondary section is made about half that of the primary area Ap.

An alternative way to operate the ignition in general, and in particular to achieve a small coil design for a distributorless (or other application) ignition while retaining the features of the MPCDRC design (using existing high efficiency slower turn-off SCRs with fcc approximately 10 kHz) is to use other than 400 volt rated capacitors as already disclosed. Use of lower capacitance Cp, 600 volt capacitors would lead to a higher primary turns Np (higher leakage inductance Lpe) and more efficient operation of the SCR. Use of a higher capacitance Cp, 250 volt capacitors would lead to lower primary turns Np. In both cases the secondary turns Ns would be approximately unchanged. Each approach has its respective advantage which must be studied case by case based on the principles presented here.

It should be noted that in all the cases 1 through 6 above, a typical primary resistance Rp is approximately 5 milliohms and the typical DC resistance of the secondary winding is between 10 and 20 ohms (equivalent primary resistance of 4 to 8 milliohms for turns ratio N of 50). The AC resistance of the primary winding assuming Litz wire is approximately the same as the DC resistance, while the AC secondary resistance can be kept below about twice the DC resistance by appropriate design, as already disclosed. Thus, a total primary AC equivalent resistance of 12 milliohms is attainable with this design, representing a very low AC resistance not achieved by any known designs prior to the present ones.

It is noted with reference to the tables of FIGS. 5*a*, 7*a*, and 13*a* that the cross-sectional area represented by the outer post 65 is typically 10% smaller than the area of the center post 32*c*. This feature was experimentally discovered and is incorporated in the design of the core.

FIG. 14 is a half side view cross-section of a preferred embodiment of the coil invention showing an alternative means of constructing the preferred core embodiment. The main feature represented by FIG. 14 is a means to construct out of one piece 64 and a cap 68 a single core 64 (pot type core shown here) with the two differing center post diameters (area Ap of post 32*c* and area As of post 42*c*, as in FIG. 7) and connected outer core sections 65 and 66. The structure is convenient for a pot core design since height W2 is larger than W1 and a mold is easily constructed to produce the shape 64 shown, while cylindrical cap 68 is simple to fabricate. Similarly, one can design a laminated E core wherein cap section 68 can be obtained in two equal section lengths 1c from an inner section of length 1c by removal of the winding window sections W1 and W2 in two steps wherein length 1c and width W1 is first removed and section of width W2 is removed as a second operation to minimize waste of the lamination material.

In this drawing is also shown a preferred secondary winding 62 which has an initially variable turns per layer (Nti per ith layer) so that the lower voltage layers 62a can contain more turns per layer since they need only a small clearance 62c to ground, and the higher voltage layers 62b contain fewer turns per layer. For example, one can have the following sequence of turns per layer, Nt1=36, Nt2=35, Nt3=34, . . . , Nt16=21, Nt17=20, Nt18=20, and the remaining layers having twenty turns per layer.

While the design principles presented herein are applicable to pot cores and "E" cores, they can also be applied in other types of cores as briefly presented next.

FIG. 15 is a variant of a standard form of high leakage inductance coil winding modified to more optimally use the design criteria of the present invention. The main feature here is to recognize that the winding 71 on the primary winding post 73 of area Ap produces the major part of the leakage inductance, and the winding on the secondary winding post 74 of area As the minor leakage, and hence As can be made, say, half of Ap as per the principles presented herein, as long as in this particular case the secondary winding produces less than half the leakage magnetic flux density and leakage inductance Lpe. Note that in the prior cases practically all the leakage inductance is produced by the primary winding. The area Aps will be between Ap and As and can be experimentally determined.

The invention as presented herein has certain further useful aspects, some of which were discovered as the very consequence of using the features of the invention.

For example, when using the invention in a MPCDRC ignition with a preferably high efficiency high output power converter of the type disclosed in patent application Ser. No. 179,953, one is able to fire many pulses, e.g. 10 to 20 pulses per ignition firing, and one is able to keep the initial primary voltage Vp of 350 volts from falling below 200 volts. When doing this in conjunction with a spark plug with a toroidal gap, one notes the tendency of the multiple spark pulses to move along the periphery of the toroidal gap to a greater or lesser extent depending on the time between pulses. For example, for a period of 100 usec between pulses (defined as Toff, equal to (Ti-Te) with reference to FIG. 2a), the spark pulses tend to cluster in one region, while for a period Toff of 400 usec they tend to spread uniformly around the periphery of the gap. Moreover, the sparking sound at the higher Toff time is more of a crackle (with higher breakdown voltages of the subsequent pulses) indicating that the spark plasma has more fully recovered (towards an insulating dielectric) between pulses.

This phenomenon has several consequences. First, it indicates a natural tendency for the spark remnant (fully discussed in patent application Ser. No. 131,948) to reside on the outer surface of the spark discharge versus in the center of the discharge (as indicated by the tendency of the pulses to move sideways along the toroidal gap). This phenomenon will be further enhanced in the flame environment where chemi-ionization will increase the electrical conductivity at the surface of the discharge (location of the flame front or reaction zone). Hence, the phenomenon of Pulsed Flame Discharge Ignition (PFDI) first disclosed in patent application Ser. No. 131,948 will only be further enhanced by the ability to utilize more pulses per firing and to modulate the pulse train firing frequency as disclosed.

Secondly, this phenomenon gives further credence to the model for the decay of the spark discharge and growth of the flame front discharge with time constants of 50 usec (and density scale of 10**11 electrons/cc) as per the PFDI model. More recent evidence indicates a time scale of 100 usec as the appropriate time scale (and a somewhat higher density scale).

In patent application Ser. No. 131,948, in-cylinder air-motion, type of fuel, plug tip geometry, etc, are shown to play a role in the formation of a large flame kernel as a result of the PFDI phenomenon. The present invention, in the form of a MPCDRC ignition with many pulses at a high energy, e.g. later pulses having about the same energy as the initial pulses, will allow for more effective design of the overall ignition operation to improve initial flame growth. For example, it has been experimentally observed that with a long pulse train where the time Toff is gradually increased (modulated) between 200 usec and 400 usec, the voltage Vp, which initially drops slowly to say 250 volts (from a high of 350 volts) will recover and at the later, e.g. tenth pulse, be back up to 350 volts to further increase the size of the initial flame kernel.

These features, e.g. PFDI effect, are more optimally utilized by means of a plug of the EFFL type mentioned above and further detailed below for the present application.

Figure 16:
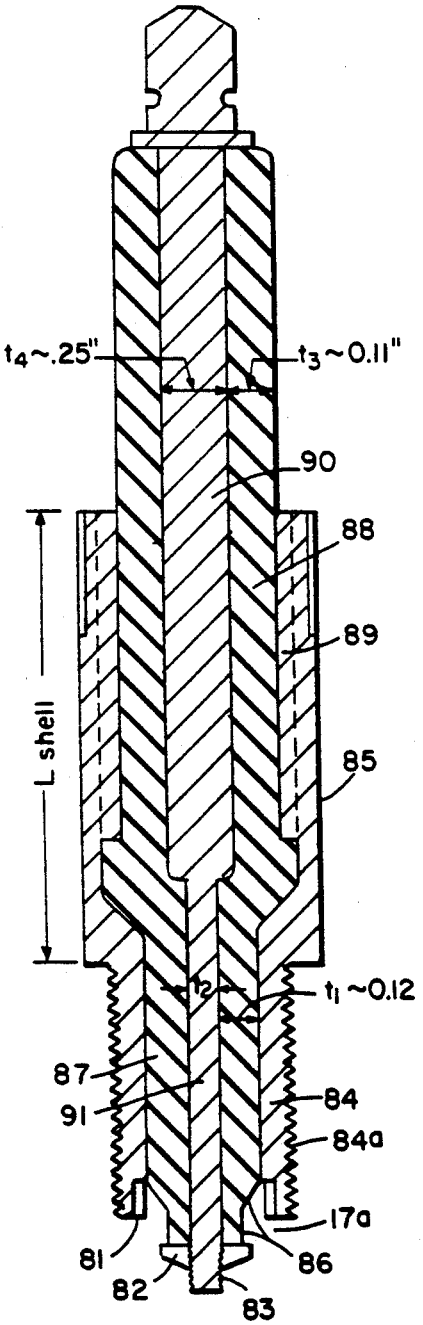
FIG. 16 is a cross-sectional view of a preferred embodiment of an EFFL type spark plug suitable for use with the present coil invention when used as part of an MPCD ignition system.

FIG. 16 is a cross-sectional view of a preferred embodiment of a toroidal gap EFFL type spark plug suitable for use with the present coil invention, and particularly used as part of an MPCD ignition system with many pulses per spark firing. Such a plug has been disclosed in U.S. patent application Ser. No. 131,948, with this version being particularly well suited for the present coil application. The plug is shown approximately twice scale and is based on a standard design having a 14 mm thread 84a whose length (reach) is approximately ¾ inch.

Center conductor section 91 of diameter t2 is preferably in between 0.1 and 0.125 inches so that with tight fitting insulator 87 of thickness t1 of approximately 0.12 inches and conductor 84 a significant capacitance of 10 to 20 pF is provided. Center conductor section 90 of thickness t4 of approximately ¼ inch provides a capacitance of 15 to 30 pF with insulator layer 88 of thickness t3 (of approximately 0.11 inch) and tight fitting outer metallic layer 89 contained in (or part of) metallic shell 85. Shell 85 is preferably of length Lshell between 1 and 1.5 inches to provide, with capacitance along plug threaded portion, a total moderate value of plug capacitance of approximately 40 pF (for alumina insulator) to provide minimally sufficient capacitive spark without unduly loading, i.e. lowering the open circuit peak voltage Vs. Spark plug insulator 88/87 is preferably high purity alumina (95%+) of approximate thickness shown to provide the moderate value of required 40 pF capacitance. Use of higher dielectric constant material, e.g. dielectric constant of about 30 (versus 9 for alumina) will allow for a design of a plug similar to standard plugs in so far as overall length is concerned since the capacitance of standard plugs is typically 10 to 15 pF.

Spark gap 17*a* is preferably approximately 0.1 inches for engine applications of moderate, e.g. 8.5:1, compression ratio. Material of erosion resistant plug tip 82 and annulus 81 are preferably of Tungsten-Nickel-Iron, Tungsten-Nickel-Copper, or other erosion resistant material to withstand the higher peak current of about two amps and the larger number of pulses per ignition firing made possible by the improved ignition system. Spark plug tip 83 may be present for near TDC (Top-dead-center) engine firing to the piston (or rotor, or other compression means) as disclosed in U.S. Pat. No. 4,774,914, wherein there is also disclosed a preferred ignition firing envelope with a peak breakdown voltage of, say, 30 kV and a minimum breakdown voltage of, say, 8 kV.

Figure 16A:
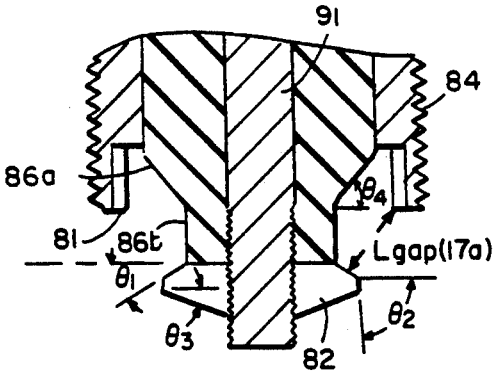
FIGS. 16*a*, 16*b* are a fragmentary cross-sectional views of preferred embodiments of the spark firing end of the spark plug of FIG. 16.

With reference to FIG. 16*a*, there is depicted a fragmentary partial view of the plug tip defining angles theta1 of preferably 0 to 30 degrees, theta2 of 60 to 90 degrees, theta3 of 0 to 30 degrees, and theta4 of approximately 45 degrees to define a concave insulator surface 86*a*/86*b*. The center electrode button 82 is of thickness t5 approximately 1/16 inch to help concentrate the electric field at its edge to reduce the breakdown voltage (from excessively high values). Length Lgap, as already stated, is preferably 0.1 inch for typical gasoline engine applications.

Figure 16B:
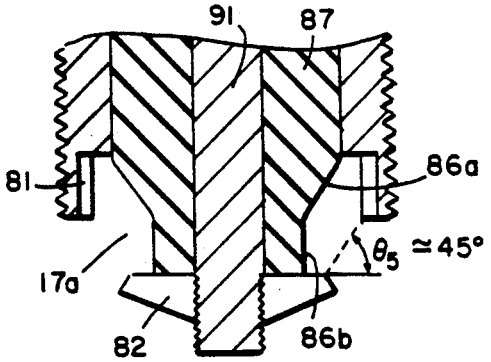

A preferred embodiment of the plug tip of FIG. 16*a* is shown in FIG. 16*b*. End button 82 has the following approximate values for the angles defined:

theta1 = 0 degrees
theta2 = 60 degrees
theta3 = 18 degrees
theat4 = 48 degrees

The angle the spark makes with the vertical, theta5, is preferably approximately 45 degrees as shown. This is achieved by using a diameter of button 82 of approximately 0.28 inch and an annulus 81 which is recessed and defines a diameter of 0.38 inch versus 0.35" defined by the diameter made up of the sum of the thicknesses t2 plus 2*t1. Note that button 82 of FIG. 16 is similar to that of FIG. 16*b* except angle theta2 is 90 degrees in the case of FIG. 16 to make for a simpler design. From dimensional considerations, length of surfaces 86*a* and 86*b* are approximately 0.08 inches for the typical gasoline engine applications. Clearly, where it is practical, these dimensions will be larger, e.g. ⅛" to provide a larger gap Lgap of greater than ⅛". For example, in low compression ratio e.g. 7 to 1, two stroke engines, or cases where piston firing at TDC is possible, larger gaps Lgap are possible.

There are numerous special applications of the coil invention, especially when it is used with an MPCDRC ignition circuit. For example, in the case of engines using alcohol fuels, e.g. methanol, ethanol, etc., the ability to deliver hundreds of watts of ignition power over several milliseconds to deliver hundreds of millijoules of energy to the air-fuel mixture, especially under cold start conditions, could allow alcohol fueled cars to start at very low temperatures without other assistance and to operate as successful lean burn vehicles. Moreover, it is a simple matter to use the above-described structure to extend the duration of the non-decaying or very slowly decaying (or first decaying and then growing) pulses during the engine cranking stage by means of the ignition controller so that, say, about twice the normal energy (compared to idle engine operation) is delivered to the air-fuel mixture.

Besides ignition applications, the present coil, i.e. transformer invention, lends itself to other applications where high leakage inductance is required (achieved through a side-by-side winding). For example, the power converter of U.S. Pat. No. 4,868,730, which operates into a capacitive load which is charged to about half the maximum value as dictated by the transformer turns ratio, could be more optimally designed by having a somewhat smaller secondary winding core center post to provide a larger secondary winding window (and preferably wider window to provide more turns parallel to the leakage magnetic flux lines as already disclosed for low AC resistance) and/or to accomodate Litz wire which may be required at the preferred higher frequency of operation of 40 kHz to 100 kHz.

The side-by-side feature of this invention lends itself to further improvements and flexibility of design of both the coil and of the entire ignition system. In particular, as depicted in the preferred embodiments of FIGS. 17 to 21, the coil makes for very low cost, compact, and more universally applicable ignition systems, particular in the form of at least two types of pure distributorless ignition systems.

Figure 17:
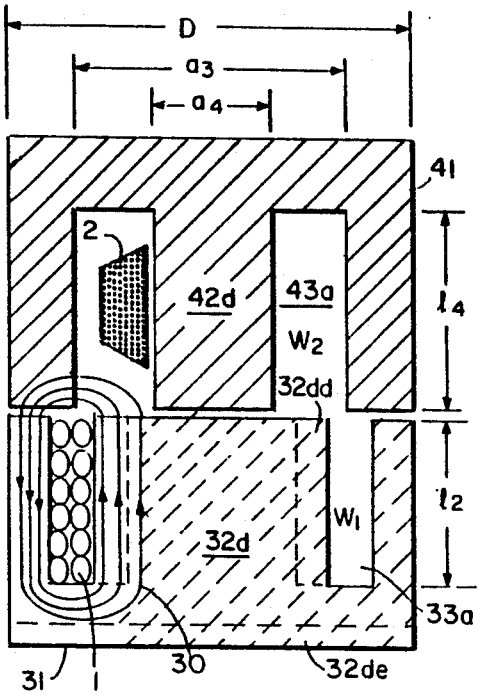
FIG. 17 is an ignition coil featuring different materials for the two halves of the core comprising the core of the coil.

It is particularly worth noting that with reference to FIGS. 4, 5, 8, and 13, each half core 31 and 41 can be made of different magnetic materials. In FIG. 17 is depicted a low loss, preferably ferrite, magnetic material core half 31 in which the primary wire 1 is wound, and a low cost (higher loss) high magnetic saturation material, such as Silicon Iron (SiFe), core half 41 on which the secondary winding 2 is wound.

In a preferred embodiment (of FIG. 17), the secondary core half 41 can be made of low cost 7 mil (0.007 inch) laminations to the dimensions of a Single Phase—⅝ LSW EI lamination, as per the Thomas and Skinner handbook, excepting that the length of the leg 14 is preferably shorter, e.g. 1 inch. The primary core half 31 can be made of the ferrite pot core design given in "Case 5", of approximately 2⅝ diameter (as in the 5/9 LSW EI lamination, i.e. D = 2⅝) with a ferrite ring 32*dd* added to the center leg 32*d* to provide an approximately 1.55" center post diameter, and a disc 32*de* added. In this way, for a primary number of turns Np of 12 and for the remaining parameters assumed from the example of "Case 5", the secondary core half 41 is stressed to approximately 1.0 Tesla and the primary core half is stressed to approximately 0.3 Tesla for an suitable design for the maximum stressed open circuit voltage condition of 30 kV. During the spark firing condition, the magnetic flux is carried principally by the low loss primary core 31 versus by the high loss laminated core half 41, making for a more optimal use of the characteristics of the two materials used.

In this regard, one can view this use of disimilar magnetic materials as a more optimal design in that one is using each material to advantage. One uses the much higher saturation flux density of SiFe to reduce the center post (42) area As of the secondary core 41 to approximately ½ square inch for approximately half the length of secondary winding wire and better than half the resistive losses (when one factors in the AC loss effect). This material's higher losses are acceptable because of the very short duration of the open circuit high voltage condition, i.e. the core is subject to a high magnetic flux (above 0.25 Tesla) only for the first few usecs of the first spark pulse of the multi pulse ignition train. For example, using the more optimal newer developed 7 mil laminations (which cost only 50% higher than 14 mil lamination) one has the highest possible losses of a few kilowatts at the peak flux density of 1 Tesla and for a maximum rise time of a few microseconds for a total energy loss of about 5 to 20 millijoules. This is acceptable given the typical total energy dissipation in the first pulse is about 30 millijoules. During the spark firing condition the magnetic flux is carried mainly by the primary low loss ferrite core 31 so the secondary core high losses do not compromise the design.

By comparison, in the typical preferred embodiments of two ferrite pot core halves, the secondary pot core half 41 is stressed far less during the spark firing condition (and hence under-utilized in this condition) since most of the (uncancelled) magnetic flux 30 is contained in the primary core half 31, and hence the properties of the secondary core half 41 are not fully used.

Figure 17A:
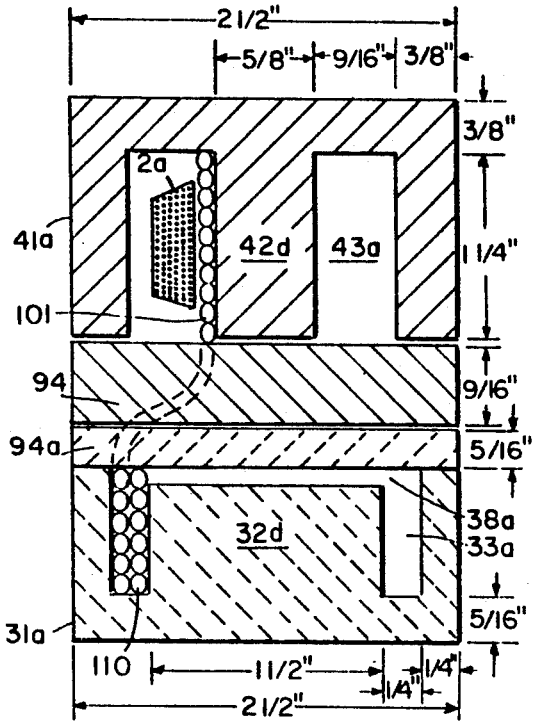
FIG. 17*a* is an ignition coil in which the major part of the leakage inductance Lpe is provided by a separate external choke whose core material is preferably low loss material such as ferrite and transformer section being preferably of Silicon Iron or other low cost high saturation flux density material.

FIG. 17*a* is a preferred embodiment of a coil sized similarly to that of FIG. 17 with preferred approximate dimensions shown for the present application, and wherein the primary winding 1 is split into two windings, one winding 101 contained in the laminated section 41*a* (with an isolating standard lamination 94 which is part of a no waste lamination construction), the other winding 110 contained in the primary core half 31*a* now representing an actual separate choke uncoupled from the secondary winding 2*a*. Winding 101 contained in (compact coil) structure 41*a* comprises a very low leakage inductance primary winding of a compact transformer or coil with very low winding losses. Each part (41*a* and 31*a*) represents a stand alone device having respective cap ends 94 and 94*a*. As a single unit they can, for example, share, the laminated cap 94 between them.

In the preferred embodiment shown the coil has approximately 8 primary winding turns Np1, i.e. 6 to 10 turns, and approximately 400 secondary turns Ns, i.e. turns ratio N of 50 for the present application already disclosed, and a very low leakage inductance Lpel (which typically measures at about 2 uH). Smaller gauge litz wire is used for the primary winding, e.g. approximately No. 12 Litz wire with 30 to 33 gauge stranded wire, and preferably 27 to 31 gauge magnet wire for the secondary winding 2*a*. The primary core 31*a*, of approximate dimensions shown, has preferably approximately 12 turns of (approximately No. 10 Litz) wire Np2, and an air-gap 38*a* for adjusting the leakage inductance Lpe2, which is equal to approximately the total inductance Lpe in this case, say approximately 50 uH for the discharge capacitor value Cp of 5 uF. In operation the configuration of FIG. 17*a* does not differ from that of FIG. 17, excepting for the differing number of turns Np1 and Np2 (Np1=Np2 normally), and the advantages which may accrue due to the separation of the two functions, the transformer function and the leakage inductance function.

By decoupling part of the primary winding from the secondary winding, the AC losses of the secondary winding are reduced due to a lower primary winding leakage flux cutting the secondary winding turns. Hence, relatively heavier secondary winding wire can be used. It also reduces the overall transformer core losses by weighing the total core losses in proportion to the leakage inductance of each part, so that the lower loss separate leakage choke 31*a* has a much higher weighting factor (by designing Lpe2 to be much greater than Lpe1). In this way lower cost, higher magnetic saturation, higher loss material, e.g. SiFe, can be used for the first transformer part to reduce overall cost and losses.

An alternative form of design is to wind the coil part 41*a* as a side-by-side winding which may provide, for example, 10 uH of leakage inductance. In this way, the required leakage (choke) inductance of the primary part 31*a* can be reduced to, say, 40 uH for a total 50 uH leakage inductance. This would allow the number of turns of the choke winding 110 to be reduced by 20%, from, say, 12 turns to 10 turns. During spark firing the core of coil 41*a* would thus carry 20% of the total magnetic flux which would be acceptable for a higher loss material and would make for a better overall balance of magnetic stress (flux density between the two parts).

The main advantage of this design is that simple and low cost forms of distributorless ignition now become possible by allowing the single leakage choke Lpe2 to be shared between several transformer coils 41*a* (with very low leakages Lpe1) which can be made very small and cheap through the use of SiFe laminated magnetic core material.

Figure 18:
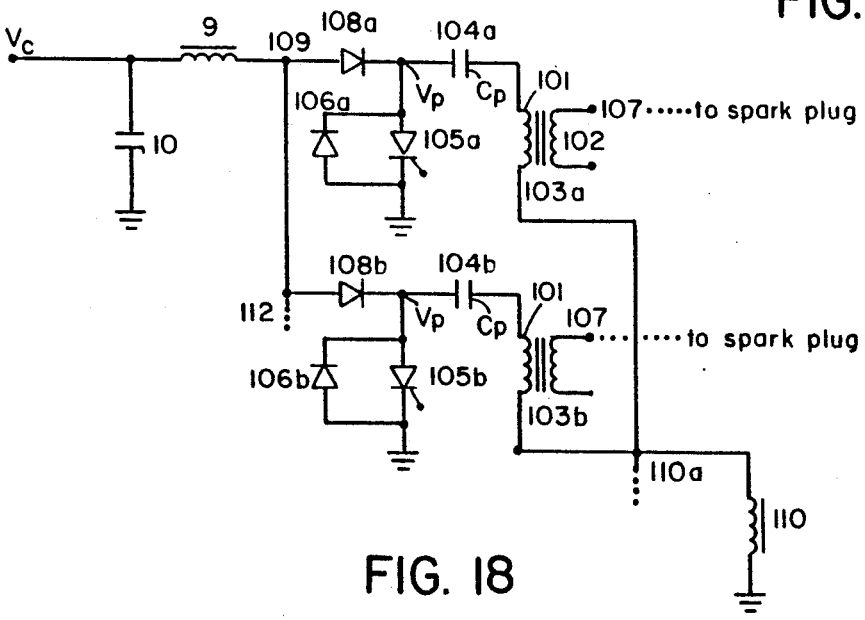
FIG. 18 depicts a distributorless form of ignition discharge circuit in which a single external leakage choke serves for two or more compact transformer coils.

FIG. 18 depicts a preferred embodiment of such distributorless ignition system in circuit diagram form based on the conventional CD circuit topology disclosed herein. It shows two compact coils 103*a*, 103*b*, it being understood that more can be added by cascading from points 112 and 110*a*. A single leakage inductor designated as 110 is shown which is shared by the compact coils 103*a*, 103*b*.

In this embodiment, each compact coil 103*a*, 103*b*, . . . , has generic primary winding 101, secondary winding 102, high voltage terminal 107, associated discharge capacitors 104*a*, 104*b*, isolating diodes 108*a* and 108*b*, and SCRs with return diodes 105*a*/106*a* and 105*b*/106*b*. Such compact coils are preferably of the type 41*a*, and leakage inductor choke preferably of the type 31*a*, both shown in FIG. 17*a*. The two (or more) coil circuits are tied together at terminal 109 which is preferably connected to recharge circuit choke 9 (as already disclosed).

In operation, when gate of SCR 105*a* is triggered, negative voltage VP (preferably approximately 350 volts) appears almost totally across primary winding 101 of respective coil 103*a* since its primary (or magnetizing) inductance Lp1 is generally at least one order of magnitude greater than the choke inductance Lpe, e.g. about 1 mH for Lp versus 50 uH for Lpe. Upon spark formation by secondary winding 102 (of coil 103*a*), inductance presented by the primary winding 101 drops to the primary leakage inductance Lpel, which is much less than choke inductance 110 (Lpe), and node point 110*a* oscillates with approximate voltage $-Vp^*\cos(wt)$. Hence, the non-firing circuit (of coil 103*b*) is inactive, excepting that the voltage seen by the SCR/diode pair 105*b*/106*b* may be up to close to double that otherwise seen.

Figure 19:
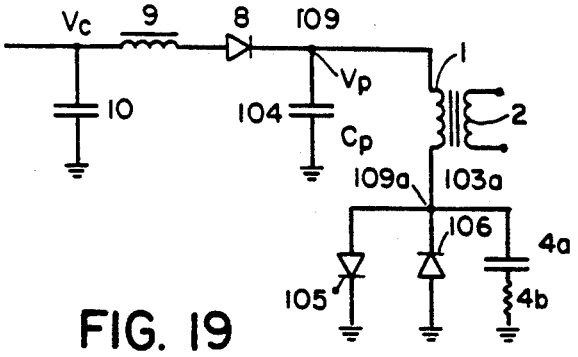
FIG. 19 depicts an alternative topology of spark ignition capacitive discharge circuit now made possible as a result of the presence of an isolation choke (of a recharge circuit).

FIG. 19 depicts an alternative form, i.e. topology, of spark ignition capacitive discharge circuit which is particularly well suited for distributorless type ignition systems. This preferred embodiment is made possible as a result of the presence of the isolation choke 9 of the recharge circuit comprising capacitor 10, choke 9, and diode 8. In this topology, designated as ACD, the discharge capacitor 104 is connected between the output of the recharge circuit, node 109, and ground, and not in series with the transformer primary winding 1. SCR 105 and diode 106 are connected, as shown, between the low side of primary winding 1 and ground. Capacitor 4a and resistor 4b constitute a snubber pair, wherein capacitor 4a can have a value as small as about 0.01 uF for the case where a preferred SCR is used which has a high rate of rise of recovery voltage, such as a TAG S4014MH SCR.

In this ACD topology, when SCR 105 is triggered node point 109 is brought to ground and a positive voltage Vp appears across primary winding 1 to create a high voltage across the secondary winding 2 to break down a spark gap. The spark current oscillates between the series combination of capacitor 104 and primary winding 1 through SCR 105 in the first half cycle, and through the shunt diode 106 in the second half cycle. In the second half cycle a second path is possible, permitting capacitor 104 to discharge through diode 8. But since recharge circuit choke 9 is present, and since its typical inductance is over a hundred times greater than Lpe, i.e. about 20 mH versus about 50 uH for Lpe, the second path is in effect blocked due to its two orders of magnitude or greater impedance. In this way, the topology of FIG. 19 is an alternatively equally valid capacitive discharge circuit for the case in which the recharge circuit (with choke 9) is used.

Figure 19A:
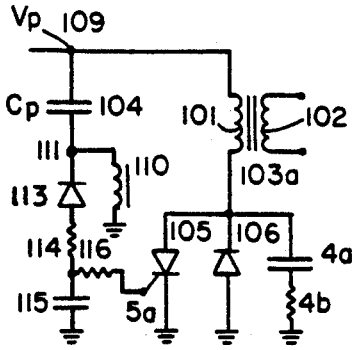
FIG. 19*a* is a preferred embodiment of the alternative capacitive discharge circuit (ACD circuit) with a separate external choke placed in a preferred position.

FIG. 19a is a preferred embodiment of the alternative capacitive discharge circuit (ACD circuit) in which a separate external choke 110 is placed in the preferred position shown, i.e. between capacitor 104 and ground. In operation it is the same as that of FIG. 19, excepting that whereas node 109 of FIG. 19 oscillates as Vp*cos(wt) during a sparking discharge cycle, node 111 oscillates as −Vp*cos(wt), assuming inductance of inductor 110 (Lpe2) is much greater than leakage inductance Lpe1, e.g. 50 uH versus 2 uH. Hence, node 111 is suitable for providing a negative bias to gate 5a of SCR 105 during spark discharge to speed up the turn-off of SCR 105. Fast turn-off circuit comprises high voltage diode 113, resistor 114 (typically a one to two watt resistor of value 1 kilohm to 5 Kilohm), capacitor 115 of value about 0.1 uH, and gate resistor 116 of typical value 100 to 500 ohm. Such speed-up turn-off has been disclosed in U.S. Pat. No. 4,841,925.

Figure 20:
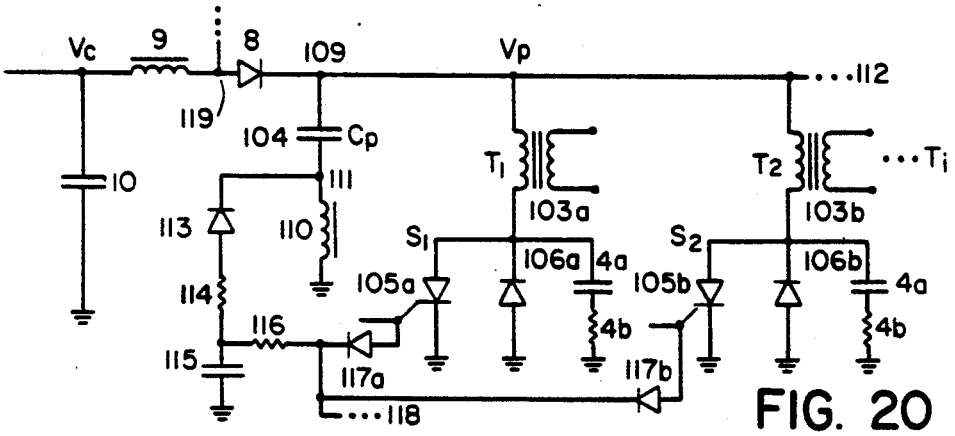
FIG. 20 is a circuit drawing of the preferred distributorless ignition in which one discharge capacitor and one external leakage inductor serve several compact ignition coils.

FIG. 20 is a circuit diagram of the preferred distributorless ignition system based on the ACD topology in which one discharge capacitor 104 and one external leakage inductor 110 serve several (N number) compact ignition coils T1 (103a), T2 (103b), . . . Ti, . . . TN. In this preferred embodiment, cascaded circuit sections comprising the series combination of the primary winding of the compact coils T1, T2, . . . , Ti, with their respective SCRs (shunted by a diode) are each in series with the capacitor 104 and choke 110 to form a complete ignition firing circuit. That is, primary winding of coil 103a with its SCR and shunt diode (combination 105a/106a) comprise a series section also in series with capacitor 104 and choke 110, as does primary winding of coil 103b and the SCR/shunt diode combination 105b/106b (the switch), and so on for additional coil/-switch series combinations cascaded from point 112 as shown.

In operation, when SCR 105a is triggered, as in the case of FIG. 19a, voltage Vp appears across primary winding of coil T1 to fire its spark gap. Upon firing of T1, node 109 is at a voltage whose maximum value equals (Lpe1/Lpe)*Vp, which is typically well below 1/20 of Vp, or below 20 volts, i.e. Lpe1 is typically about 2 uH and Lpe is typically about 50 uH. Hence, coils T2, T3, . . . , cannot fire their respective spark gaps since at most they can see 20 volts across their primary windings, which is not sufficient to fire their respective spark gaps even at the low pressure conditions of cylinders of multi-cylinder engines, which may, for example, be near the bottom of the intake stroke during firing of a cylinder under compression.

During the second half discharge cycle all the shunt diodes 106a, 106b, . . . , represent possible paths for the return current. However, since all but the primary winding of the fired coil T1 present their magnetizing or primary inductance Lp which are much greater (100 to 1000 times greater) than the leakage inductance presented by the fired coil (T1), then essentially all the current returns through the shunt diode 106a of the triggered SCR. In this way, each compact coil (with preferably concentric, very low leakage inductance windings of typically 1 to 2 uH) can be fired independent of the others, and a low cost, simple form of distributorless ignition system is attained.

In this preferred embodiment speed-up turn-off circuit made of like components as in FIG. 19a (components 113, 114, 115, 116) requires an additional diode for each additional transformer to isolate each gate from the other, diode 117a for gate 105a, diode 117b for gate 105b, and others as required connected to node 118.

While not explicitely shown, it is clear that in distributorless ignitions one needs sensors to trigger each SCR of each coil at its appropriate time in the engine cycle. As a retrofit kit for ignitions currently having a distributor, the high voltage terminals of the distributor can, for example, be grounded through say 100 ohm resistors, and the distributor used as a dummy firing distributor to fire each coil at its appropriate time.

While the parallel, part circuits, of the series combinations of coils T1, T2, . . . , Ti, and switches S1, S2, . . . , Si, cannot be fired simultaneously (unless leakage inductor 110 is eliminated and built into each transformer Ti), effective simultaneous firing of, say, two coils (T1 and T2) can be achieved by alternatively triggering their respective SCRs from a pulse train with firing to non-firing duty cycle of less than 50% each. Alternatively, a second bank of coils, switches, etc., can be connected to node point 119 through a second isolating diode similar to diode 8 to thus have a second independent set of coils with their own leakage coil and discharge capacitor. Such an embodiment would be particularly well suited in the case of rotary engines and certain two stroke engines which use two plugs per rotor. For a three rotor engine, one would require two sets (connected to node point 119) of three coils T1, T2, T3, and T1', T2', T3', each set having one discharge capacitor (104, 104') and leakage choke (110, 110'), and all the units being driven by one high power, high efficiency, power converter and one recharge circuit. Alternatively, one can further reduce the system parts count by having only one set of six coils with only one discharge capacitor 104 and leakage inductor 110 and fire the coils in pairs on alternative pulses of an otherwise two-fold longer duration spark pulsing train of less than 50% duty cycle.

Figure 21:
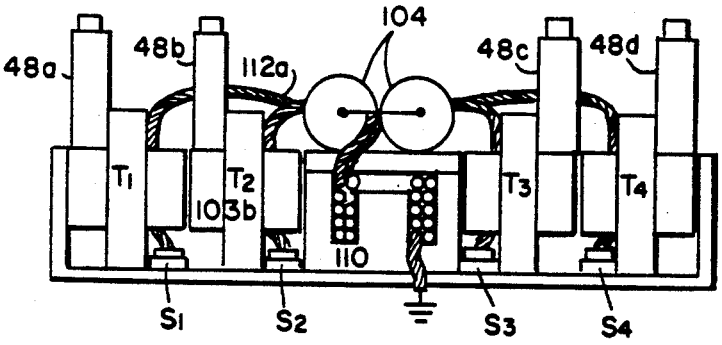
FIG. 21 is an approximately half scale schematic of an actual distributorless ignition of FIG. 20 for a four cylinder engine.

FIG. 21 is an approximately half scale schematic of an actual distributorless ignition of FIG. 20 for a four cylinder engine. In this preferred embodiment, compact coils T1, T2, T3, T4 and choke 110 are of similar design as transformer (coil type) 41a and leakage choke 31a respectively of FIG. 17a. Capacitors 104 (one or more in parallel capacitors) are preferably located at the site (two shown) of leakage inductor 110, as are the speed-up turn-off circuit comprising parts 113, 114, 115, and 116 (see FIG. 20).

In this one of many possible parts configuration the coils T1 to T4 and choke 110 are shown in line with the coil high voltage towers 48*a*, 48*b*, 48*c*, 48*d* located on the side and above the winding (101/2*a* as per FIG. 17*a*). Each switch S1 through S4, which is preferably an SCR with built in diode, is shown located at the site of each respective coil and mounted on a grounded case 120.

Another configuration for the coils and choke is an essentially circular one in which choke 110 and capacitor 104 are located at the center and the coils on a perimeter around parts 104/110.

Another configuration is one in which switches S1 through S4 are directly mounted (without insulation) to a grounded heat sink 120, i.e. with the SCR anode tab directly mounted to 120. This is accomplished by having the power converter voltage Vc (FIG. 20) be of negative polarity, and the SCRs and the diodes comprising switches S1 through S4 reversed in direction from that shown in FIG. 20. The gates of the SCRs must then be isolated. Also, in this configuration (with reference to FIG. 20) leakage choke 110 would be preferably located on the high voltage side of discharge capacitor 104 defining a new node point 111' between them (not shown) and the cathode of diode 113 connected to the point 111'.

Figure 22:
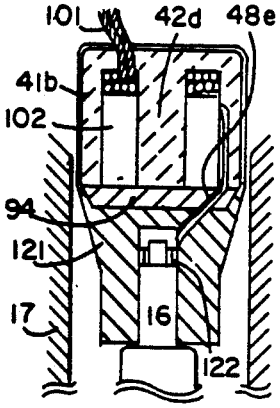
FIG. 22 is an approximately half scale schematic of a particularly small compact coil for mounting directly over a spark plug.

FIG. 22 is an approximately half scale schematic of a very small compact coil Ti (as in a distributorless ignition of FIG. 20 showing multiple compact coils T1, T2, . . .) wherein the coil core material is made of a formed, i.e. pressed or molded, material of inherently high saturation flux density, or of a material which in molded form exhibits the ability to sustain a high impressed magnetic field. The coil core material can be made of low cost moderate loss Powdered Iron or Silectron, Hi-Flux powder material (an Arnold Nickel-Iron material), or any of a variety of high saturation flux density materials. Preferably, the shape of the core (and hence coil) is an elongated pot core structure 41*b* with a cap 94 and cylindrical center post 42*d* of preferably approximately ⅝ inch diameter for the present application. Preferably primary and secondary windings 101 and 102 are side-by-side windings of, say, approximately eight turns of primary wire and 440 turns of secondary wire for a somewhat higher turns ratio N of 55. This elongated design shown is suitable for mounting over a spark plug 16 to provide a particularly compact overall design, with the two layered primary turns 101 located at the opposite end from the high voltage terminal of the spark plug 16 for easy connection of wire 101 to a switch S and to a leakage choke inductor Lpe and a discharge capacitor Cp. In this design, cylinder head 17 preferably has a well for supporting the entire compact coil structure. The high voltage lead 48*e* is preferably contained in an elastic (silicone) material 121 comprising special spark plug boot which is mounted over the spark plug and connected via a terminal 122.

It should be appreciated that other useful configurations of a (low leakage inductance) compact coil are possible once the separation of the overall coil structure has been made into a high leakage choke part 110 and a compact transformer coil part Ti. In addition, it should be appreciated that the alternative topology of capacitive discharge circuit of FIG. 19 (designated as ACD) made possible by the use of the isolation choke 9 of the recharge circuit 14 (FIG. 1) is more useful than the basic CD circuit (designated as BCD when needing to distinguish it from the ACD circuit) in using the compact coil for distributorless ignition.

In FIG. 21 was shown a schematic of a side view of a possible layout of the coil assembly, as it shall also be referred to hereinafter, of the distributorless ignition. In FIG. 23 is shown an approximately full scale drawing of a top view of a preferred embodiment of the coil assembly for a four cylinder engine. The drawing is in part fragmentary in that only one of the switches S1 is shown in detail, as is the case for compact coil T1.

Figure 26:
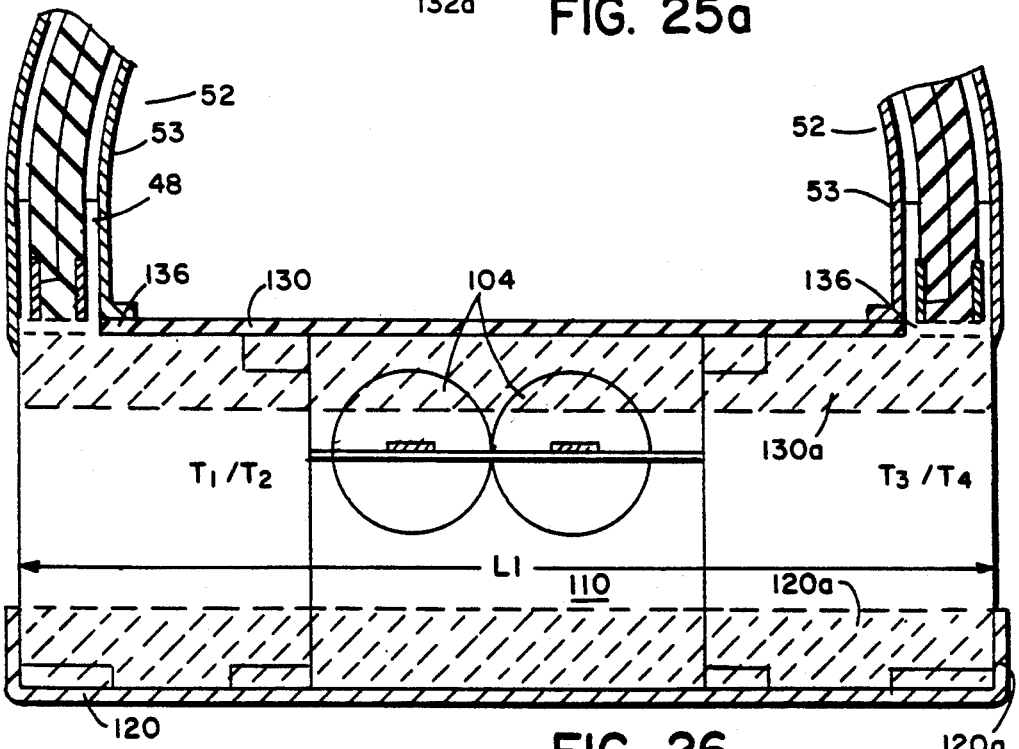
FIG. 26 is an approximately full scale side view of a coil assembly of the distributorless ignition of FIG. 23 depicting a preferred sandwiching design for holding the parts.

In this preferred embodiment of FIG. 23, the compact coils T1, T2, T3, T4 are placed at the corners of a rectangular plate 120, with the coil high voltage towers 128*a*, 128*b*, 128*c*, 128*d* preferably placed on the outside of the plate as depicted. The leakage inductor 110, or resonating inductor, is placed between a pair of the compact coils, between T1 and T3 in this case, with the discharge capacitor means 104 placed either on top of inductor 110 as shown, or alongside inductor 110 between coils T2 and T4 as indicated in the embodiment of FIG. 26.

In the present case, one end of the inductor winding (110*a* of FIG. 23*b*), designated as 110*aa*, is conveniently connected to one end of capacitor means 104 via strap 111. The other end of the inductor winding, 110*ab*, is connected to a ground plane 125 which is preferably placed on the plate 120. In this configuration, the SCR/diode pairs S1, S2, S3, S4, are preferably mounted on the plate 120 as shown, which acts as an excellent heat sink for the devices and also allows for convenient placement of the terminals of the devices onto a single ground pad 125 and to each of four respective high voltage pads (pad 126 shown for SCR 105*a* and diode 106*a*). The high voltage pads are in turn used to make respective connections to a primary winding end of each coil (connection to end 112*a* of primary winding 101 of coil T1 shown in the drawing). The other ends of the four primary windings of the coils T1, T2, T3, T4, are connected to pad 124 which is connected to capacitor means 104 and to feed voltage terminal 109.

In this preferred embodiment only one snubber is used, which is comprised of capacitor 4*a* and resistor 4*b*, connected between the high voltage strap 124 and ground. The snubber action is not as effective as having a snubber for each semiconductor pair S1 through S4, but is adequate for proper operation of the discharge circuit. Also shown are the fast turnoff circuit comprised of the diode 114, resistor 114, resistor 116, and capacitor 115, as per FIG. 20. The compact coils shown, T1 through T4, are a preferred embodiment of the coil shown in FIG. 23*a*. In these drawings, the coils have a square center leg 132 and a window 133. Fasteners for mounting the plate can be conveniently placed as shown in locations 131 and 131*a*, consistent with the orientation of the coils.

FIG. 23*a* depicts a full scale drawing of a side view of a preferred compact coil on the form of laminations, preferably the relatively new low cost, low loss 7 mil laminations. In this design, a winding window 133 of width 0.5 inch is shown to be sufficient for accommodating the primary winding 102 and secondary winding 2*a*, based on the primary winding 101 comprised of rectangular copper strip of approximately 0.1" wide by 0.040" thick. The thickness is approximately equal to and greater than the skin depth at the preferred operating discharge frequency of 10 KHz to give an AC resistance no higher than 50% of the DC resistance. Eleven turns of primary winding are shown here and approximately 600 turns of secondary winding of approximately 30 gauge wire.

A consideration in arriving at this design is to provide a higher primary inductance at the open circuit operating frequency of approximately 30 KHz. Laminated material has a decreasing effective permeability with frequency, and given it is desired to have an open circuit inductance Lp1 at least three or four times greater than the leakage inductance Lpe (for 75% to 80% available voltage Vp to the compact coils), then preferably magnetic path length "l" should be as small as practical.

In this design, a preferred overall dimension is D=2½" by L=2¼", giving a scrapless design (½" wide I-section 94) and high cross-sectional area with ¾" center leg 132 and winding length 15 of 1¼". With these dimensions, and approximately twelve turns of primary wire, one achieves an inductance Lp1 of approximately 160 uH at a frequency of 30 KHz, requiring a preferred leakage inductance Lpe of 40 to 50 uH for the above 75% to 80% condition, and Cp of 6 uF for a discharge frequency of 10 KHz.

FIG. 23*b* depicts an approximately full scale side view of the resonating inductor 110, with the approximate dimensions shown and an air-gap 129 of approximately ¼" to provide the required inductance Lpe of 30 to 60 uH. Preferably, the inductor is made of low-loss ferrite material. With the eleven turns of wire 110*a* shown and a discharge frequency of 10 KHz, maximum flux density Bm for Vp of 350 volts will be about 0.4 Tesla. Preferably, the total series AC resistance of the resonator winding 110*a* and the coil primary (101) and secondary windings (2*a*) be about 20 milliohms (mohms), i.e. 10 to 30 mohms, for the 10 KHz spark firing or coil output shorted condition.

Figure 24A:
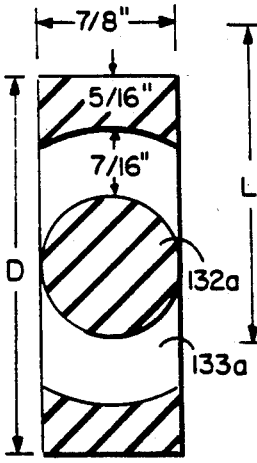
FIGS. 24*a*, 24*b* are top and side views of the core of preferred compact coils made of ferrite or other shapeable material.
Figure 24B:
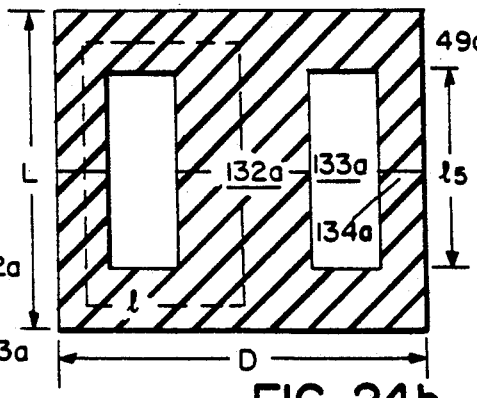

FIGS. 24*a* and 24*b* depict top and side views of the core of preferred compact coils made of ferrite or other shapeable material. For the dimensions shown in FIG. 24*a*, D is 2⅜" making it ideal for the layout of FIG. 23, which would imply a length L2 of the plate of 4¾" which would more optimally accommodate the preferred 2½" diameter resonating inductor 110 and the switches S1 through S4. Note that for the coils of FIG. 23*a*, dimension L2 would be 5" to accommodate pairs of them as shown.

In the preferred embodiment of FIG. 24*a* center post 132*a* is ⅞" for ferrite material, assuming primary wire of approximately eleven turns, Np=11, and secondary turns Ns=600. A round post as shown allows for the somewhat smaller window 133*a* shown. These dimensions can be reduced if a material of higher saturation flux density is used, but it must have an effective permeability of a minimum of approximately 250 at 30 KHz to have a minimum inductance Lp1 of 150 uH at 30 KHz for Np approximately equal to ten turns. Currently available powdered iron is limited to a permeability of 90.

With reference to FIG. 24*b* the window length 15 is arbitrary since we are not dealing with a lamination (of scrapless design), but a powdered type material. In this case, assuming Ns=600, one could preferably select 15=1½", which would allow one to wind the secondary turns 2*a* (see FIG. 23*a*) with eight layers of preferably 29 gauge copper wire for minimum AC resistance, versus 10 layers of 30 gauge wire for the window dimensions of FIG. 23*a*.

Figure 25:
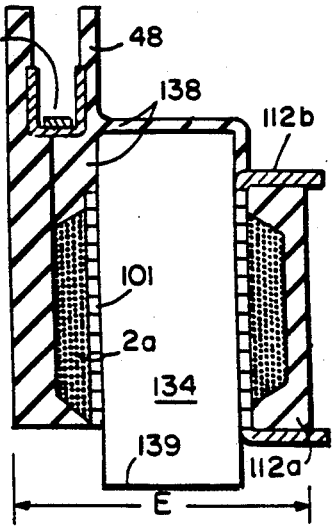
FIG. 25 is an approximately full scale drawing of an end view of a compact coil showing a preferred high voltage tower design.

FIG. 25 is an approximately full scale drawing of an end view of a compact coil in its completed, encapsulated form with a preferred high voltage tower 48. The primary winding, preferably of strip copper, comprises one layer with ends 112*a*, 112*b* emerging out of the bottom and top as shown. With reference to FIG. 23, end 112*a* connects to switch pad 126 of S1 (assuming coil is in the T1 position), and end 112*b* to pad 124.

Preferably the overall width E is approximately equal to or less than 2" (1⅞" shown), which is achieved in part by placing the tower 48 such that its center terminal 29*a* is vertically above (and preferably slightly inwards) of the last winding layer of the secondary winding 2*a*. The encapsulant 138 may cover the top of the core 134 but should not cover the bottom 139 which is preferably heat sunk to the plate 120 (FIGS. 23, 26).

Figure 25A:
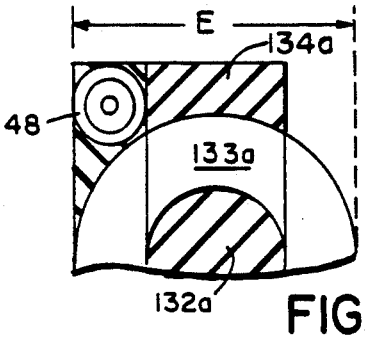
FIG. 25*a* is a fragmentary top view of a compact coil showing an alternative placement of the high voltage tower.

In the fragmentary view of FIG. 25*a* is shown a different placement of the high voltage tower 48 to a corner adjacent to an end section 134*a* of the core to make for a somewhat more compact design of minimum "E" dimension.

FIG. 26 is an approximately full scale side view of the coil assembly of FIG. 23 showing a preferred embodiment of mounting and holding of the various parts. In this embodiment, the coils T1, T2, T3, T4 are sandwiched between two plates, plate 120, the bottom mounting and heat sink plate, and plate 130, the top plate which acts also as a electrical ground for the shields 53 of the preferred shielded spark plug wire 52. Plate 130 can also act as a secondary heat sink by being bolted to plate 120 with heavy metallic bolts required for sandwiching the two plates. Plates 120 and 130 preferably have containing lips 120*a* and 130*a* to hold the coils and resonating inductor 110 in place.

With respect to the grounding plate 130, the high voltage tower openings 136, in combination with the towers 48, can easily be constructed such as to accommodate the shielded type spark plug boots in common use in German vehicles, i.e., the coil end of the spark plug wire having a metallic boot similar to the one on the spark plug end, except that the boot would make its electrical contact on its outside with the inside edge of the opening 136.

It should be noted with respect to FIGS. 23 and 26 that the orientation of the coils T1 through T4 are such as to require an integer number of turns Np of the primary winding 101. This is especially important in minimizing losses for the case that the core material comprised of center post 132, sidewall 134, and end cap 94 is of electrically conductive material, such as laminated SiFe material.

It should be further noted that the coil invention disclosed herein has many features, details, and applications, the essentials of which can be more succinctly disclosed in terms of the single coil of FIG. 4, for example, described in a more generic way along with the coil assembly of FIG. 21, wherein the primary winding of the single coil, and the resonating inductor of the coil assembly, are designated as the principal leakage inductance comprising leakage inductor of inductance Lpe, and the means of coupling to the one or more secondary windings is either directly through magnetic flux coupling between said principal leakage inductance winding 1 and the secondary high voltage winding 2 (of FIG. 4 for example), or indirectly by means of one or more extensions of said leakage winding, i.e. extension sections primary windings 101 extending from the principal leakage winding 110 (of FIGS. 17*a* and 23, for example), said sections comprising one or more primary windings 101 coupled to one or more secondary windings 2a of FIG. 17a or 102 of FIG. 23, for example.

FInally, it is particularly emphasized with regard to the present invention, that since certain changes may be made in the above apparatus and method without departing from the scope of the invention herein involved, it is intended that all matter contained in the above description, or shown in the accompanying drawings, shall be interpreted in an illustrative and not in a limiting sense.

What is claimed is:

1. An ignition coil system for a capacitive discharge ignition system including at least one discharge capacitor means, at least one switch means, and at least one ignition coil including a primary high current winding means with a principal leakage inductor of inductance value $L_{pe}$ coupled to at least one secondary high voltage winding by one of a) direct coupling through magnetic flux, or b) indirect coupling through primary winding extensions of said principal leakage winding with said extensions comprising a primary winding portion closely coupled to at least one secondary winding.

said ignition coil system constructed and arranged to perform two functions, a) a high voltage breakdown discharge function whereby a high voltage of about 15 kV to 45 kV is produced between high voltage terminals of said at least one secondary winding means to break down a dielectric across a spark gap, and b) an energy delivery function whereby high spark current of order of magnitude of one amp flows across said spark gap.

and wherein, consistent with the above, said ignition coil system is further constructed and arranged such that the structures controlling each of the open circuit high voltage breakdown discharge function and the high current spark discharge function are specified separately according to 1), 2), and/or 3) below, where:

1) for low saturation ferrite type material, the magnetic core section on which the secondary winding is wound is constructed and arranged such that for the peak of said high voltage the maximum magnetic flux density $B_s$ (at 60 degrees F.) in said core is within 30% of the level given by $B_{smax}$, where:

$$B_{smax}=[K/UF][V_p/(2f_{oc}N_pA_s)]$$

where k is the coupling coefficient, $V_p$ is the voltage to which the discharge capacitor is charged, $f_{oc}$ is the open circuit high voltage frequency, $N_p$ is the number of primary winding turns, $A_s$ is the area of the core on which the secondary winding is wound, and UF is the unity factor given by $UF=[1+N^2C_s/C_p]$, and 2) for low saturation ferrite type material, the magnetic core section on which the principal leakage inductance winding is wound is constructed and arranged such that for the peak of said high spark discharge current the maximum magnetic flux density $B_p$ (at 60 degrees F) in said core is within 30% of the level given by $B_{pmax}$, where $$B_{pmax}=V_p/[2(pi)f_{cc}N_pA_p]$$

where $f_{cc}$ is the short circuit high current spark discharge frequency and $A_p$ is the area of the core on which said principal leakage inductance is wound, pi=3.142, and 3) for core material of high saturation flux density, i.e. non-ferrite type, the magnetic core section on which the secondary winding is wound is constructed and arranged such that at the open circuit frequency $f_{oc}$ the open circuit primary inductance $L_{pl}$ which is directly coupled to said secondary winding is equal to or greater than three times the leakage inductance $L_{pe}$, whereby the circuit parameters and magnetic material properties and dimensions are enabled to be further selected to produce more optimized operation of said ignition coil system with low electrical losses and minimum sizing of magnetic parts, said magnetic parts comprising materials selected from the class of a) ferrite type materials satisfying one or both of the above relationships 1) and 2), and b) non-ferrite materials of higher magnetic saturation flux density satisfying the above relationship 3).

2. A system as defined in claim 1 wherein the ignition coil system comprises at least one ignition coil with a principal leakage inductor directly coupled to a secondary high voltage winding, and wherein said principal leakage inductor comprises a primary winding wound about a separate primary winding core of winding cross-sectional area $A_p$ and said secondary winding is wound about a separate secondary winding core of area $A_s$, said separate primary and secondary cores constructed and arranged such that at least some of the primary core magnetic flux produced when the primary winding is excited by means of an external voltage $V_p$ producing primary winding current $I_p$, is directly coupled to the secondary winding core to excite the secondary winding to induce voltage therein, the ratio of the areas of the primary core $A_p$ to the secondary core area $A_s$ being between 1.5 and 3.0.

3. A system as defined in claim 2 wherein said primary winding has turns $N_p$ of between 5 and 15, and the primary winding has a number of turns $N_s$ such that the secondary to primary turns ratio N, equal to $N_s/N_p$, is between 25 and 75, both $N_p$ and N being more precisely selected depending on the required value of the peak secondary voltage $V_s$ and the value of the primary winding peak voltage $V_p$, also equal to the voltage to which the capacitor means of the capacitive discharge system is charged.

4. A system as defined in claim 1 wherein the ignition coil system comprises a primary winding portion principal leakage inductor of turns $N_p$ and of inductance $L_{pe}$ coupled indirectly through primary winding extensions, each of turns $N_{p1}$ wound on one compact core per extension with secondary high voltage windings of turns $N_s$ and turns ratio N wound on each extension and directly coupled to said primary winding extensions, said compact coils whose leakage inductance $L_{pel}$ is about equal to or less than one tenth of $L_{pe}$, and wherein switch means comprises one switch $S_i$ per compact coil Ti connecting one end of the primary winding extension to ground either directly or indirectly through a path including capacitor means and/or principal leakage inductor, said system as defined above comprising a distributorless ignition system in that when switch Si is turned on, compact coil $T_i$ is energized through capacitor means charged to voltage $V_p$ to produce a high breakdown voltage Va and one or more sparks at the secondary winding terminals by primary current being conducted through said compact coil's primary winding and the principal leakage inductor without the remaining compact coils being energized to create breakdown sparks.

5. A system as defined in either of claims 3 or 4 wherein $V_p$ is between 300 and 400 volts, $V_s$ is approximately 30 kV, Np and Np1 are each between 7 and 13, and N is between 45 and 75.

6. A system as defined in claim 5 wherein capacitor means of capacitance $C_p$ is selected in combination with a) a total capacitance $C_s$ of said secondary windings and other capacitances connected to secondary winding terminals, and b) turns ratio N, such that the conditions of voltage doubling are satisfied by construction of the system such that the ratio [$P_N2$)*Cs/Cp] be less than 0.2.

7. A system as defined in claim 6 wherein leakage inductance Lpe is between 30 and 60 uH, $C_p$ is approximately equal to 6 uF, $C_s$ is between 100 and 300 pF, and the ignition circuit discharge frequency fcc is approximately 10 kHz.

8. A system as defined in claim 7 wherein said capacitive discharge circuit is multi pulsing capacitive discharge circuit further including a recharge circuit including a capacitor of capacitance $C_e$, and inductor of inductance $L_e$, and a diode, to provide closely spaced, i.e. 200 to 500 microsecond (usec) interval spark pulses of approximately constant or slowly increasing interval between pulses.

9. A system as defined in claim 8 wherein capacitive discharge circuit is of the or ACD topology in which switch means, comprising a SCR and a parallel diode, are connected between one terminal of one or more primary windings directly coupled to one or more secondary windings and ground, and the other one or more primary winding terminals are each connected in series with the leakage inductor $L_{pe}$ and capacitor $C_p$ through a common node.

10. A system as defined in claim 9 wherein leakage inductor $L_{pe}$ is connected between ground and capacitor $C_p$, and to a node between $L_{pe}$ and Cp is connected a fast turn-off circuit comprising a high voltage diode, a one to five kilo ohm (kohm) one to two watt resistor, a capacitor of value of 0.05 to 0.2 uF, and a gate resistor of value 100 to 500 ohm, and one end of the gate resistor is connected to SCR gates either directly for one SCR and one coil or through isolating diodes for more than one SCR gates of more than one compact coil $T_i$.

11. A system as defined in claim 10 including a snubber means comprising an in series capacitor and resistor connected preferably between feed voltage terminal where recharge circuit connects to ACD circuit or said common node and ground.

12. A system as defined in claim 11 wherein Le is between 5 and 30 millihenry (mH), $C_e$ is between 0.2 and 0.6 of $C_p$, and the snubber capacitor of said snubber means is of the order of magnitude of 0.05 uF.

13. A system as defined in claim 3 wherein its coil's separate primary and secondary cores are two different core halves which define a closed magnetic path within the core material when they are used as a pair, the cores and other selected from the class of pot cores, E cores, ETD cores, PM cores and other related closed cores having an inner winding center post, an end section, and a sidewall, the primary winding wound on the center post of area $A_p$ of the primary core and the secondary winding wound on the center post of the secondary core of area $A_s$, and wherein the two core halves are butted against each other linking magnetic flux via their center posts and sidewalls, with the outer diameter of the two sidewalls being essentially equal to provide for a wider winding window of width Ws for the secondary winding and a narrower primary winding window $W_p$.

14. A system as defined in claim 13 wherein the primary winding is made up of two layers of primary wire.

15. A system as defined in claim 14 wherein the primary wire is made from the class of wire whose AC resistance at the closed circuit spark discharge frequency fcc is less than a factor of two of its DC (direct current) resistance, said class including Litz wire, and rectangular strip conductor whose thickness is between approximately 1 and 1½ times the skin depth of the strip material at the operating frequency fcc, and wherein the diameter of the secondary wire is equal to about one third the skin depth.

16. A system as defined in claim 15 wherein $W_p$ is approximately ¼ inch and Ws is approximately ½ inch.

17. A system as defined in claim 16 wherein the secondary winding is layered along the length of its center post and has a variable turns $N_{ti}$ per ith layer and wherein over some range of values of layers the turns per layer $N_{ti}$ decreases so as to increase the clearance of the higher voltage turns from the (grounded) core end walls and sidewalls.

18. A system as defined in claim 13 wherein the coil winding secondary winding capacitance $C_{sc}$ is utilized for improving the coil capacitive spark ignition capability by constructing the high voltage lead connecting the coil output terminal to the spark gap to lower the frequency of transmission of the capacitive spark to 5 to 30 MHz so that is delivered with small attenuation to the spark gap while electrical energy flowing above 30 MHz is strongly attenuated.

19. A system as defined in claim 13 wherein said high voltage lead is contained in a grounded shield terminating at a coil core outer surface or at a metal plate containing or attached to the core and at an outer conducting shell of a spark plug means containing said spark gap so as to produce very low EMI.

20. A system as defined in claim 1 wherein the secondary winding open circuit high voltage output is of positive polarity, versus the conventional negative polarity, in order to minimize plug fouling, especially of plugs with a toroidal spark gap.

21. A system as defined in either of claims 3 or 4 which uses a spark plug for the device containing the spark gap which is a toroidal gap electric field focussing lens type spark plug with a firing end button tip of small diameter of between 0.20" and 0.35" and made of erosion resistant material of the class of Nickel alloy, Tungsten-Nickel-Iron, Tungsten-Nickel-Copper, and other similar erosion resistant materials, and with the plug ground ring made up of similar material, to be able to withstand the higher spark power and higher total energy per spark firing made possible by the present ignition system.

22. The plug as defined in claim 21 wherein its plug capacitance $C_{sp}$ is about 40 pf and the firing end of the plug has an approximately 0.1" spark gap which is at an approximately 45 degree angle to the vertical axis defined by the plug length to minimize the chances of plug fouling.

23. A system as defined in claim 21 in combination with an engine wherein many spark pulses per ignition spark firing are used, 10 to 20 pulses at low RPM of about 600 RPM of the engine, dropping to two to five closely spaced pulses of approximately 250 microseconds (usec) interval at 6,000 RPM.

24. A system as defined in claim 23 wherein sufficient such spark pulses are provided per firing to ignite at least half of the toroidal volume of the said focussing lens type plug at low RPM engine operation.

25. A system as defined in claim 24 wherein there is provided a variable spark pulse timing with gradually increasing time between pulses with subsequent pulses increasing by a factor of about two over the entire spark firing period.

26. A system as defined in claim 25 wherein an initial time between pulses of approximately 200 usec is used which increase to approximately 400 usec at the end of the tenth pulse and to approximately 500 usec at the end of the 15th pulse.

27. A system as defined in claim 4 and further comprising an ACD circuit with one or more compact coils whose non-switched primary winding end terminals are all connected to a common node point P of voltage $V_p$ to which one end of capacitor means Cp is connected and whose other end is connected to the principal or resonating inductor of inductance $L_{pe}$ whose other end is gounded, and an isolating choke of inductance Le is connected between node P and a power supply means working to maintain voltage $V_p$.

28. A system as defined in claim 27 wherein inductance Le has an in series diode connected to one of its terminals and a capacitor of capacitance Ce connected between it and said power supply means and ground, defining a recharge circuit, such that when the circuit is energized by firing (closing) a switch means Si of compact coil Ti, energy on capacitor Ce begins to discharge through inductor Le with current Ire to recharge capacitor Cp, with current Ire reaching near or zero current prior to subsequent firing of Si.

29. A system as defined in claim 28 wherein said compact coils are comprised of a concentric winding of single layer of primary winding of turns $N_{pl}$ about a center core post and Nt layers of secondary winding of turns Ns wound over the primary winding.

30. A system as defined in claim 29 wherein diameter D and height L of core of compact coils are each approximately 2½ inches and center post area $A_{ps}$ is approximately ½ square inch, i.e. between ⅜ and ⅝ square inch.

31. A system as defined in claim 30 wherein core is a scrapless E-I laminated core with winding window dimensions W and 15 equal to ½ inch (for width W) and 1¼ inch for length 15.

32. A system as defined in claim 31 wherein laminations are of SiFe of thickness of approximately seven mils.

33. A system as defined in claim 30 wherein $N_p$ and $N_{pl}$ are each approximately 10 turns, N is approximately 55, and the number of secondary layers Nt is between 7 and 13.

34. A system as defined in claim 33 wherein primary winding wire is of rectangular cross-section of approximately 0.10" by 0.036" and secondary winding wire is approximately 30 gauge wire.

35. A system as defined in claim 30 wherein core material of resonating inductor is ferrite of approximate diameter D of 2½ inches and approximate height of 1½ inch.

36. A system as defined in claim 27 wherein four compact coils T1, T2, T3, T4 are used and mounted on a rectangular base plate with their respective spark plug towers located on the outside part of the plate, and wherein a section is defined between pairs T1/T2 and T3/T4 of the coils in which is mounted the capacitor Cp, and the resonating inductor $L_{pe}$ and the four switches S1, S2, S3, S4 which are mounted on the base plate which acts also as a heat sink to cool inductor $L_{pe}$, the switches, as well as the coils.

37. A system as defined in claim 36 wherein a top plate is used for sandwiching said coils and other parts between itself and said base plate, the top plate also able to function as a ground plate for grounding any shields of high voltage shielded wire that may be used and also able to function as an additional heat sink for the parts sandwiched between it and the base plate.

38. A system as defined in claim 36 wherein switches S1 through S4 are each SCRs with parallel diodes, and wherein primary winding end wire sections are connected to a respective switch via a conductive pad and to one end of a pad at common node point P such that the primary turns defines an integer number of primary turns.

39. A system as defined in claim 30 wherein said compact coils are encapsulated with low dielectric constant encapsulant, i.e. dielectric constant of about 3, said encapsulant forming a high voltage tower whose center is essentially vertically above the outer last winding layer of the secondary winding such that the overall end width E is approximately equal to and less than 2.0".

40. A system as defined in claim 36 wherein compact coils are encapsulated and have overall cross-sectional dimensions of approximately 2½" by 2" to define the overall coil assembly cross-sectional dimension of approximately 5" by 6".

41. A system as defined in claim 28 wherein said compact coils are constructed and arranged so as to each be mounted on top of a spark plug.

42. A system as defined in claim 41 wherein primary and secondary windings are wound side-by-side over a center core post.

43. A system as defined in claim 42 wherein primary winding turns are approximately 8 in number and are wound on the side away from the spark plug location so that the primary winding turns emerge from the back of the compact coil for easy connection to the respective switch and to the node point P.

44. A system as defined in claim 35 wherein mean center post diameter of compact coils and resonating inductor are approximately 0.75" and 1.5" respectively.

45. A system as defined in claim 44 wherein widths of side wall and slot in which wire is wound are each approximately ¼" wide, the length along which wire is wound is approximately ⅞", and the air gap, which sets inductance $L_{pe}$ for the approximately ten turns of wire required on the basis of magnetic saturation, is about ¼", and the wire is wound in two layers.

46. A system as defined in claim 13 wherein said primary core is made of ferrite, ferrite-like, NiFe, or other low loss material and said secondary core is made of a material selected from of the class of SiFe, powdered iron, and other similarly low cost material.

47. A system as defined in claim 13 wherein a separate outer casing for the core material is used and selected from the class consisting of plastic with ferrite loading, NiFe, SiFe, powdered iron, metallic glass, any of the above in either cast or tape form.

48. The system defined in claim 15 in combination with an MPCD ignition circuit including recharge circuit means for providing 250 to 500 usec spark pulses of approximately constant or slowly decaying amplitude, and constructed and arranged such that if the first spark pulse misfires the coil will permit the recharge circuit to raise its primary, and hence secondary voltage of the second pulse to a higher value.

* * * * *